US010605249B2

(12) United States Patent
Park et al.

(10) Patent No.: US 10,605,249 B2
(45) Date of Patent: Mar. 31, 2020

(54) BLOWER

(71) Applicant: LG ELECTRONICS INC., Seoul (KR)

(72) Inventors: Heechul Park, Seoul (KR); Myungjin Ku, Seoul (KR); Jongwook Kim, Seoul (KR); Kyuhwan Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 309 days.

(21) Appl. No.: 15/654,383

(22) Filed: Jul. 19, 2017

(65) Prior Publication Data

US 2018/0023582 A1 Jan. 25, 2018

(30) Foreign Application Priority Data

Jul. 20, 2016 (KR) ..... 10-2016-0092154
Jul. 21, 2016 (KR) ..... 10-2016-0092661

(51) Int. Cl.

| | |
|---|---|
| ***F04D 25/10*** | (2006.01) |
| ***F04D 17/16*** | (2006.01) |
| ***F04D 25/16*** | (2006.01) |
| ***F04D 25/08*** | (2006.01) |
| ***F04D 29/42*** | (2006.01) |
| *F24F 13/14* | (2006.01) |
| *F04D 25/06* | (2006.01) |

(52) U.S. Cl.

CPC ..... *F04D 25/10* (2013.01); *F04D 17/162* (2013.01); *F04D 25/08* (2013.01); *F04D 25/166* (2013.01); *F04D 29/424* (2013.01); *F04D 25/06* (2013.01); *F24F 2013/1446* (2013.01); *F24F 2221/38* (2013.01)

(58) Field of Classification Search

CPC ..... F04D 25/10; F04D 25/166; F04D 25/08; F04D 25/06; F04D 17/162; F04D 29/424; F24F 2221/38; F24F 2013/1446

See application file for complete search history.

(56) References Cited

U.S. PATENT DOCUMENTS

| | | | | |
|---|---|---|---|---|
| 4,738,188 | A | 4/1988 | Nishida | |
| 6,209,622 | B1 * | 4/2001 | Lagace | F24F 3/1423 165/8 |
| 2003/0026600 | A1 * | 2/2003 | Delonghi | F04D 25/10 392/365 |

(Continued)

FOREIGN PATENT DOCUMENTS

| | | |
|---|---|---|
| EP | 1 775 524 | 4/2007 |
| EP | 1 950 500 | 7/2008 |

(Continued)

OTHER PUBLICATIONS

U.S. Appl. No. 15/653,650, filed Jul. 19, 2017.

(Continued)

*Primary Examiner* — Charles G Freay
(74) *Attorney, Agent, or Firm* — KED & Associates, LLP

(57) ABSTRACT

A blower is provided that may include an upper fan that generates a first air current suctioned through a first suction inlet and then discharged; a second fan provided adjacent to the first fan, wherein the second fan generates a second air current suctioned through a second suction inlet and then discharged. The first air current and the second air current may be in a same direction or different directions.

20 Claims, 30 Drawing Sheets

(56) References Cited

U.S. PATENT DOCUMENTS

| | | | | |
|---|---|---|---|---|
| 2009/0114377 | A1 | 5/2009 | Zheng et al. | |
| 2009/0317240 | A1* | 12/2009 | Wei | F04D 25/105 415/127 |
| 2016/0108928 | A1* | 4/2016 | Son | F24F 1/005 415/205 |

FOREIGN PATENT DOCUMENTS

| | | |
|---|---|---|
| EP | 3 009 752 | 4/2016 |
| JP | H 02-041049 | 3/1990 |
| KR | 20-1986-0013533 | 11/1986 |
| KR | 20-0278255 | 5/2002 |
| KR | 10-0838891 | 6/2008 |
| KR | 10-2008-0087365 | 10/2008 |
| KR | 10-2014-0095245 | 8/2014 |
| KR | 10-2016-0034058 | 3/2016 |
| WO | WO 2016/028034 | 2/2016 |

OTHER PUBLICATIONS

European Search Report dated Nov. 29, 2017 issued in Application No. 17182168.9.
European Search Report dated Nov. 30, 2017 issued in Application No, 17182183.8.
Korean Office Action dated May 17, 2017 issued in Application No. 10-2016-0092154.
Korean Office Action dated Jun. 14, 2017 issued in Application No. 10-2016-0092661.

* cited by examiner

BLOWER

CROSS-REFERENCE TO RELATED APPLICATION(S)

This application claims priority under 35 U.S.C. § 119 to Korean Patent Application No. 10-2016-0092661, filed on Jul. 21, 2016, whose entire disclosure is hereby incorporated by reference.

BACKGROUND

1. Field

A blower is disclosed herein.

2. Background

In general, a blower is an apparatus that suctions air and blows the air to a position desired by a user. The blower is generally disposed in an indoor space, such as a house or office, to blow air to a user in hot weather such as summer. Therefore, the blower is generally used to cool off the user.

A typical blower generally includes a supporting part and a blowing part. A related art document related to the typical blower is Korean Patent Laid-Open Publication No. 10-2008-0087365 (hereinafter "related art document"), published on Oct. 1, 2008 and entitled "Electric fan", which is hereby incorporated by reference. The typical blower includes a body having a motor mounted therein, a blade coupled to the motor to be rotatably installed at the body according to an operation of the motor, and a supporting part provided at a lower portion of the body to support the body.

In addition, a first safety cover and a second safety cover are coupled to a front of the body to which the motor is coupled such that the blade is disposed between the first safety cover and the second safety cover. The first safety cover and the second safety cover allow a user to not be in direct contact with the rotating blade.

Accordingly, if the motor in the body is driven, the typical blower blows air to the user as the blade rotates. The blower may have the same configuration as blowers widely used.

However, the related art blower has the following problems. First, the direction of air generated from the blade may only blow in one direction, and the rotational direction of the body in the lateral direction may not generally exceed 180 degrees. Accordingly, a user may be required to manually move positions of the supporting part and the body of the blower.

Second, when a plurality of spaces exist, air may be discharged to only one space from the blower. Hence, a user who is positioned in another space, for example, a rear based on the blade of the blower, to which the air is not discharged may not cool off himself/herself.

Third, the blower may not be configured to enable the user to arbitrarily control the direction of air depending on situations, and may perform a mechanical or electronic control of reciprocating and rotating the direction of air in one direction or fixing the direction of air.

BRIEF DESCRIPTION OF THE DRAWINGS

Embodiments will be described in detail with reference to the following drawings in which like reference numerals refer to like elements, and wherein.

DETAILED DESCRIPTION

Figure 1:
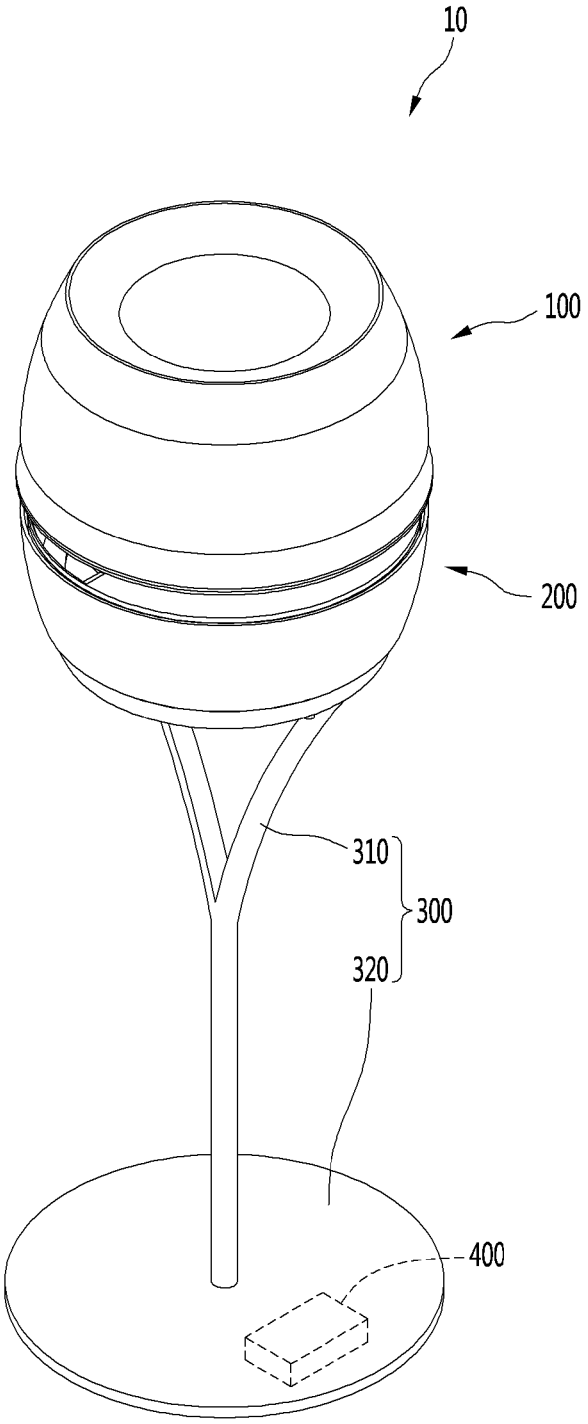
FIG. 1 is a perspective view of a blower according to an embodiment.

Hereinafter, embodiments will be described with reference to the illustrative drawings. Regarding the reference numerals assigned to the components in the drawings, it should be noted that the same components may be designated by the same reference numerals, wherever possible, even though they are shown in different drawings. Also, in the description of embodiments, specific description of known related configuration or functions may be omitted when it is deemed that such description may cause ambiguous interpretation of the present disclosure.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). In a case where it is described that any component is "connected" or "coupled" to another component, the component may be directly or indirectly connected or coupled to another component. However, it is to be understood that another component may be "connected" or "coupled" between the components.

Figure 2:
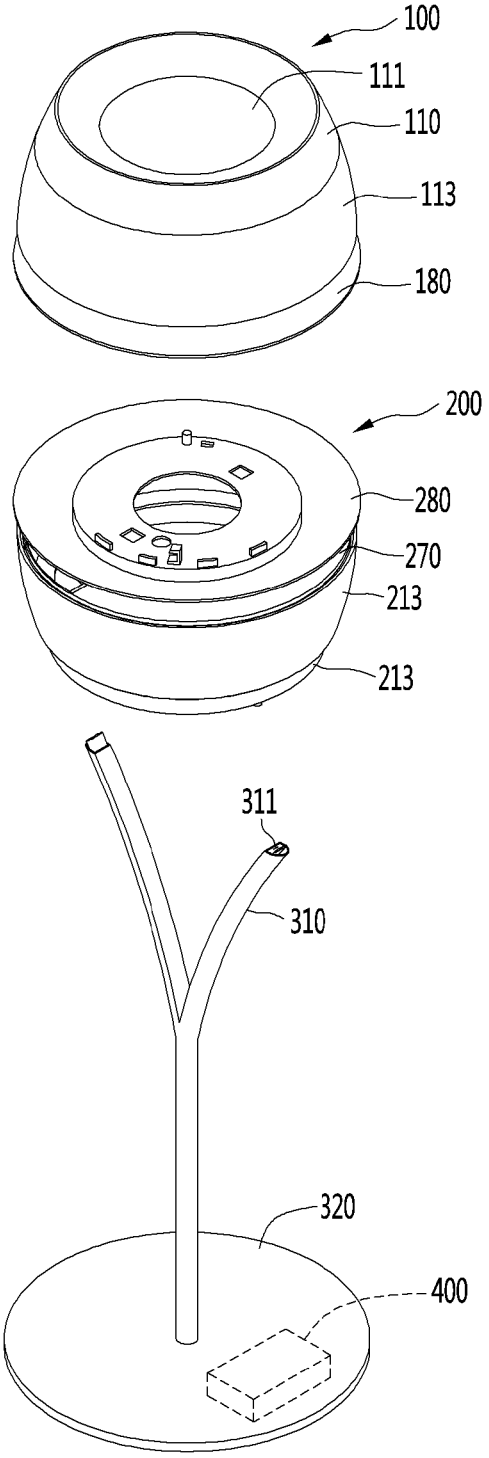
FIG. 2 is an exploded view of the blower according to the embodiment.

FIG. 1 is a perspective view of a blower according to an embodiment. FIG. 2 is an exploded view of the blower according to the embodiment.

Referring to FIGS. 1 and 2, the blower according to an embodiment may include a body 10 that generates a flow of air and a supporting part or support (or stand) 300 that supports the body 10. The body 10 may include a first blower (or first blower shell) 100 that generates a first air current A (see FIG. 21) and a second blower (or second blower shell) 200 that generates a second air current B (see FIG. 21).

The first blower 100 and the second blower 200 may be arranged in an vertical direction. In one embodiment, the first blower 100 may be provided at an upper side of the second blower 200. The first air current A may be an air current including indoor air at an upper side of the body 10, that is, an upper side of the first blower 100, suctioned into the first blower 100 and then discharged to an outside of a first end of the first blower 100. The second air current B may be an air current including indoor air at a lower side of the body 10, that is, a lower side of the second blowing device 200 suctioned into the second blower 200 and then discharged to an outside of a first end of the second blower 200.

The first blower 100 and the second blower 200 may be vertically symmetrical to each other with respect to a same central axis, and may be rotatable with respect to the central axis. The central axis may be a virtual line that connects centers of the first blower 100 and the second blower 200. However, the central axis is merely a virtual line set for directions, and is not a component having an actual shape.

The first blower 100 and the second blower 200 may have a same shape. In this case, the first blower 100 and the second blower 200 may be symmetrical to each other with respect to a vertical central axis.

The first blower 100 may generate the first air current A by suctioning indoor air at the upper side of the body 10 and discharging the suctioned air at a lower end of the first blower 100 in a first discharge direction, and the second blower 200 may generate the second air current B by suctioning indoor air at the lower side of the body 10 and discharging the suctioned air at an upper end of the first blower 200 in a second discharge direction. The discharge direction of the first air current A and the discharge direction of the second air current B may be identical to or different from each other depending on rotation directions of the first blower 100 and the second blower 200.

For example, if the first blower 100 and the second blower 200 are rotated in a first direction, the discharge direction of the first air current A and the discharge direction of the second air current B may be identical to each other. That is, when the discharge direction of the first air current A is a frontward direction with respect to the body 10, the discharge direction of the second air current B may also be the frontward direction.

In addition, the first air current A and the second air current B may be joined together to form a third air current C. The third air current C may be referred to as a "discharge air current" of the first and second air currents A and B. A vertical direction of the discharge air current may be determined according to discharge intensities of the first air current A and the second air current B. This will be described hereinafter.

As another example, if the first blower 100 is rotated in the first direction and the second blower 200 is rotated in a second opposite direction, the discharge direction of the first air current A and the discharge direction of the second air current B may be different from each other, that is, directions opposite to each other. That is, when the discharge direction of the first air current A is a frontward direction with respect to the body 10, the discharge direction of the second air current B may be a rearward direction.

A flow control when the first discharge direction of the first air current A and the second discharge direction of the second air current B are identical to each other may be defined as a 'concentrated air current control,' and a flow control when the first discharge direction of the first air current A and the second discharge direction of the second air current B are different from each other may be defined as a 'distributed air current control.' A user may determine whether the first blower 100 and the second blower 200 are to be rotated under the concentrated air current control and the distributed air current control. This will be described hereinafter.

The support 00 may be provided at the lower side of the body 10 to support the body 10. The support 300 may include a first supporting part or support (or leg) 310 which may be connected to the lower side of the body 10 to support the body 10, and a plate-shaped second supporting part (or base) 320 which may be connected to a lower end of the first support 310 and be arranged horizontally with respective to ground.

The first support 310 may extend from the body 10 to the second support 320. The first support 310 may have a shape of a Y-shaped pipe. An upper portion of the Y-shaped pipe may be connected to a lower end of the body 10, and a lower portion of the Y-shaped pipe may be connected to the second support 320.

A wire accommodating space 311 having a wire accommodated therein may be formed in the first support 310. For example, a plurality of the wire may be provided. The first support 310 may be a pipe having the wire accommodating space 311 formed therein, and the wire(s) connected to the body 10 may be introduced into the second support 320 through an internal space of the first support 310. The plurality of wires may connect the body 10 to a controller. A configuration of the controller will be described hereinafter.

The second support 320 may be connected to the lower end of the first support 310 to be mounted horizontally with respect to ground, thereby supporting the body 10. That is, the second support 320 may serve as a base horizontal to the ground.

The controller that controls an operation of the body 10 may be accommodated in the second support 320. One end of the plurality of wires may be connected to the body 10 to be provided in the wire accommodating space 311 of the first support 310, and the other end of the plurality of wires may be introduced into the second support 320 to be connected to the controller provided in the second support 320. According to this connection structure, the plurality of wires may connect the body 10 to the controller. That is, in the blower according to the embodiment, the controller and the wires may be accommodated in the support 300, so that the size of the body 10 may remain compact.

In addition, a controller 400 (see FIG. 22) provided in the second support 320 may control rotations of the first blower 100 and the second blower 200. This will be described hereinafter.

Hereinafter, a configuration of the body 10 of the blower according to an embodiment will be described.

Figure 3:
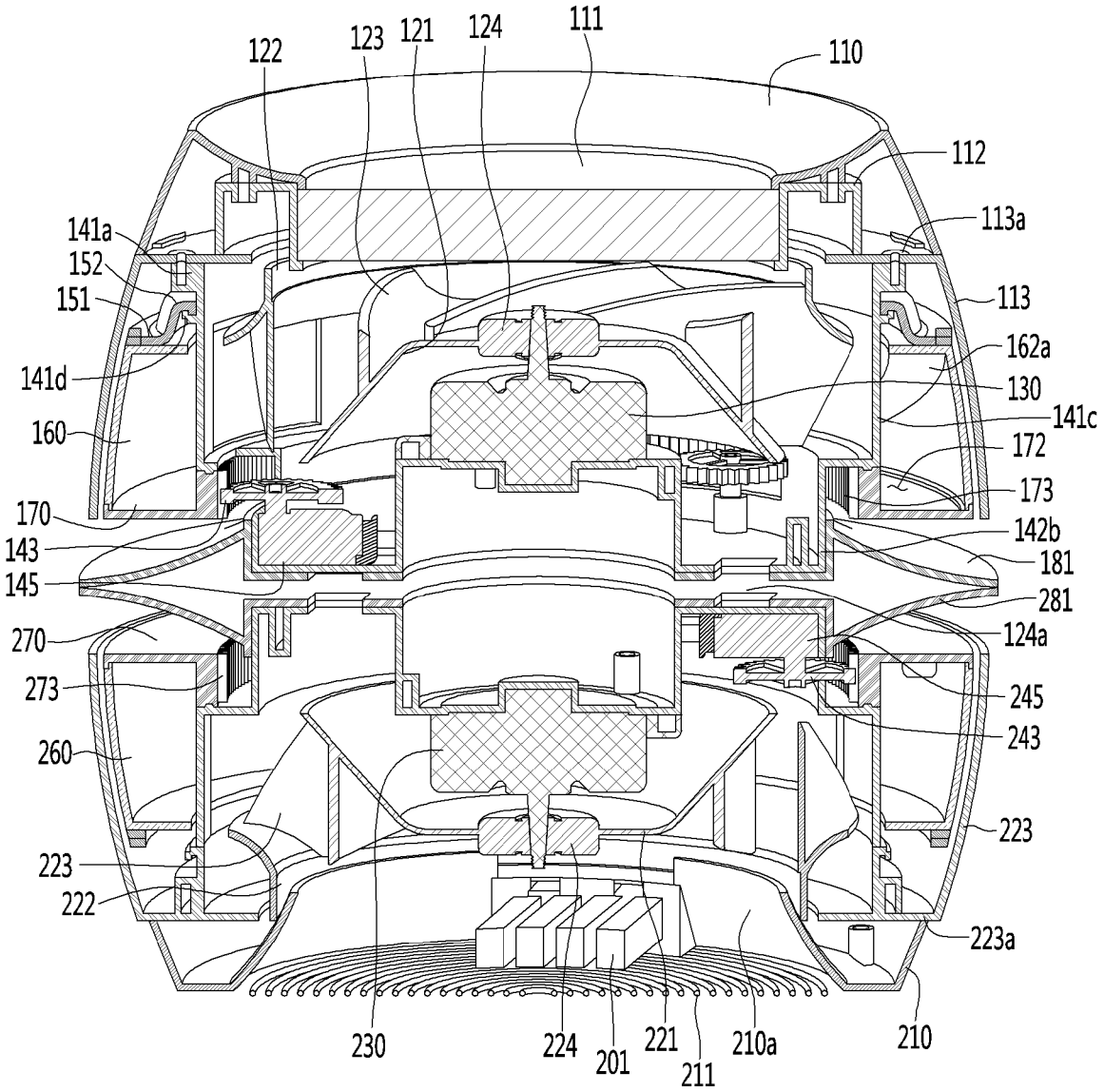
FIG. 3 is a sectional view of a body of the blower according to an embodiment.
Figure 4:
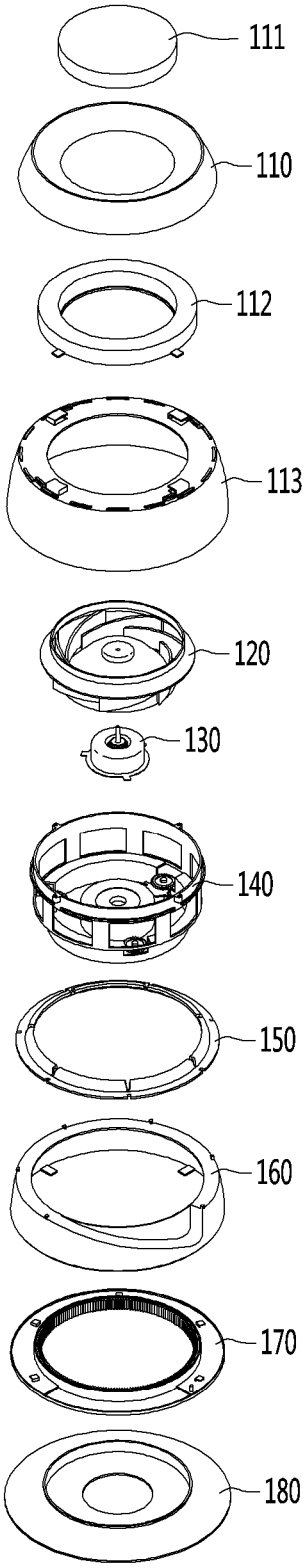
FIG. 4 is an exploded view of a first blower according to an embodiment.
Figure 5:
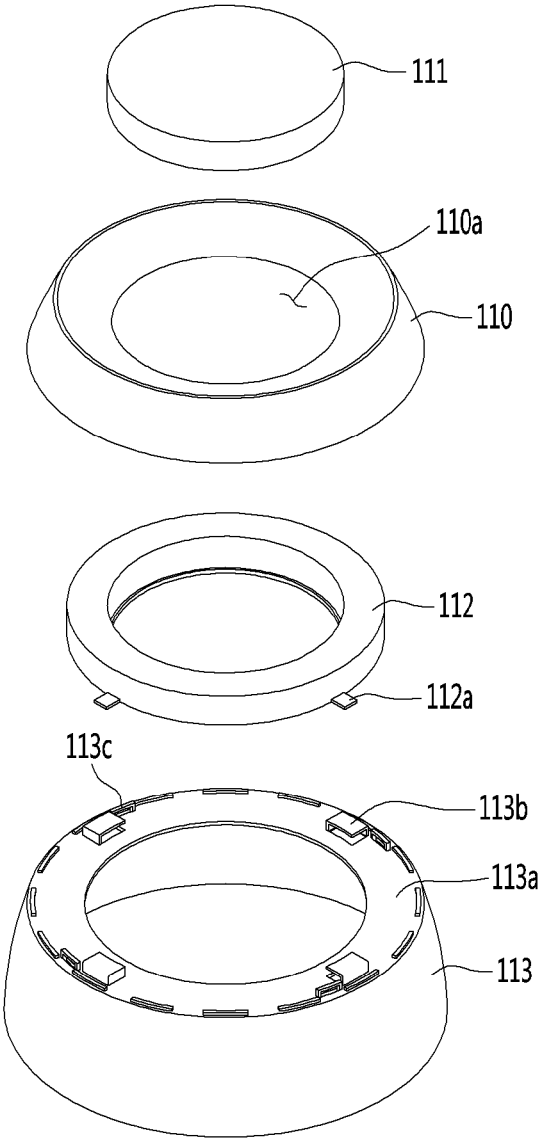
FIG. 5 is an exploded view of an upper suction inlet and a first case according to an embodiment.
Figure 6:
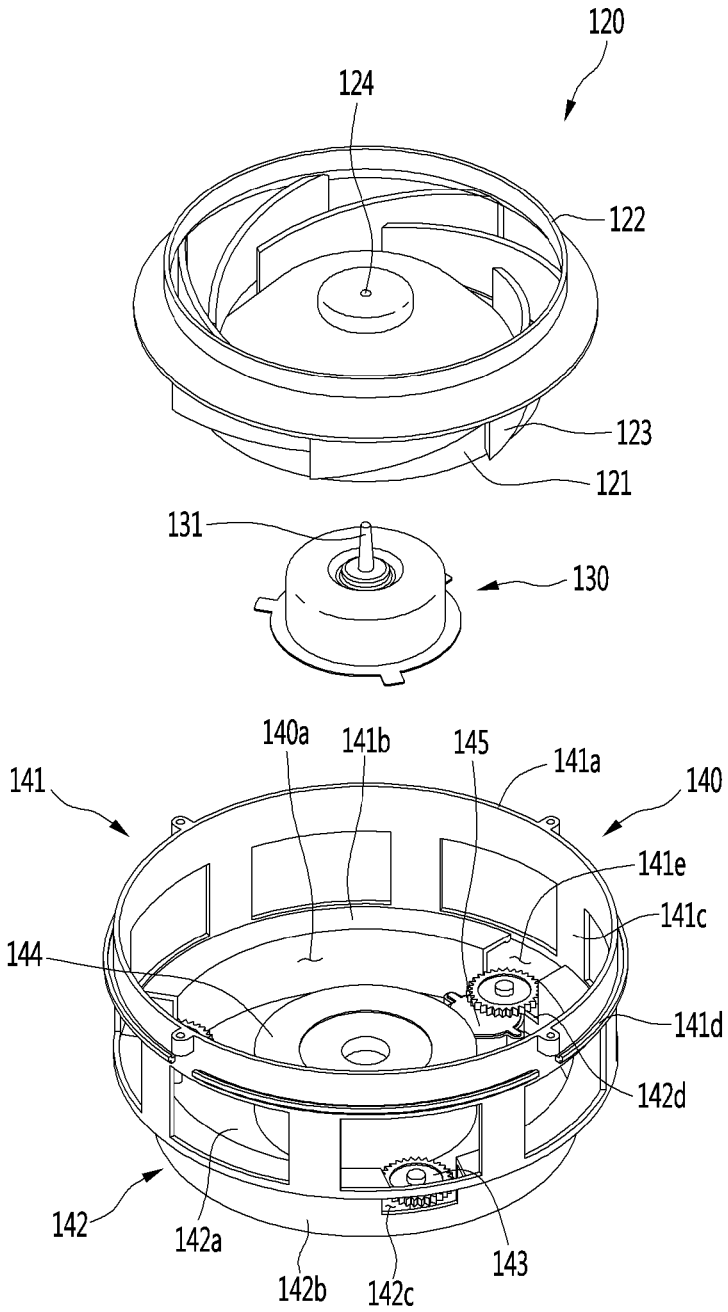
FIG. 6 is an exploded view of a first flow generating fin according to an embodiment.
Figure 7:
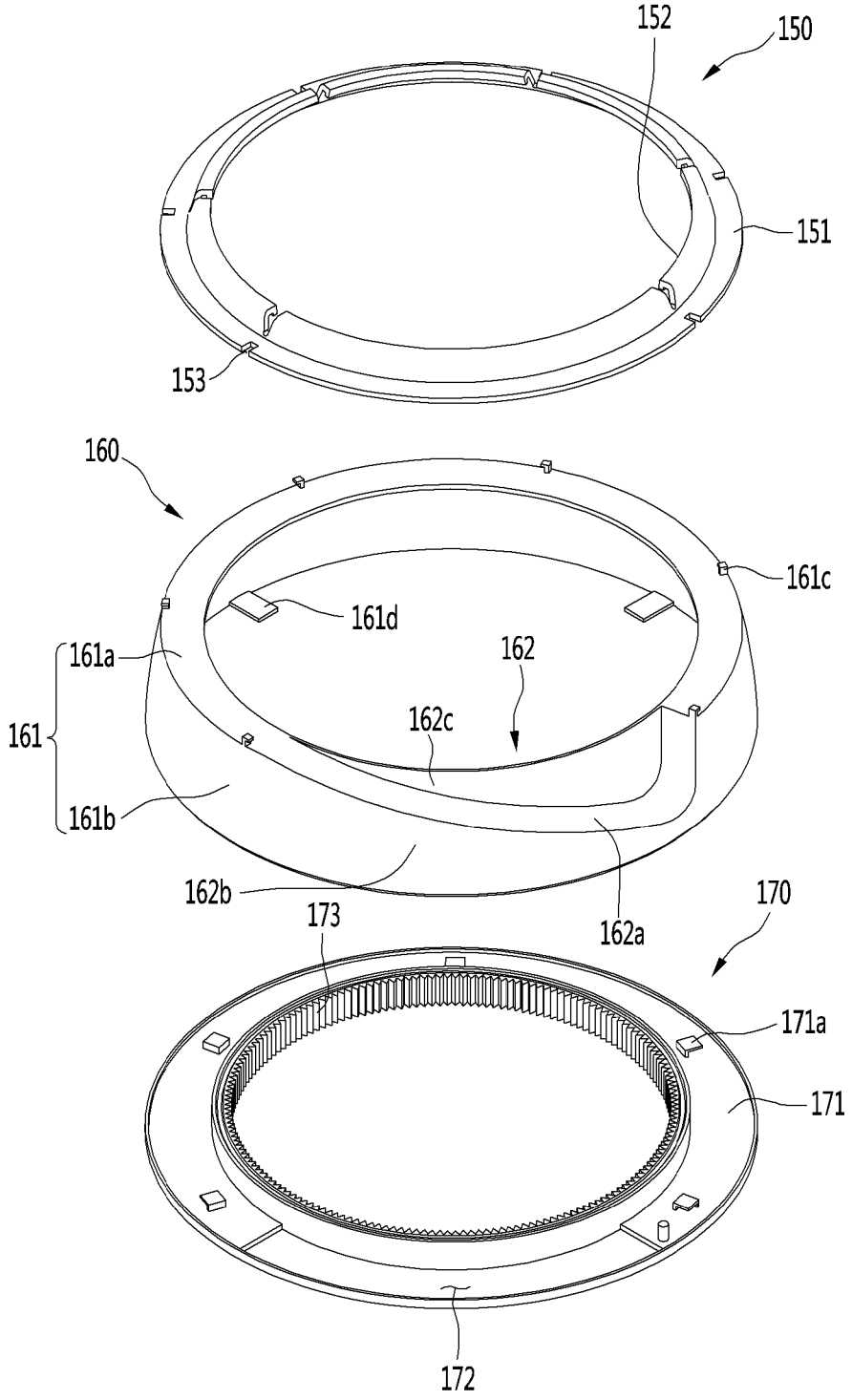
FIG. 7 is an exploded view of a first discharge guide according to an embodiment.
Figure 8:
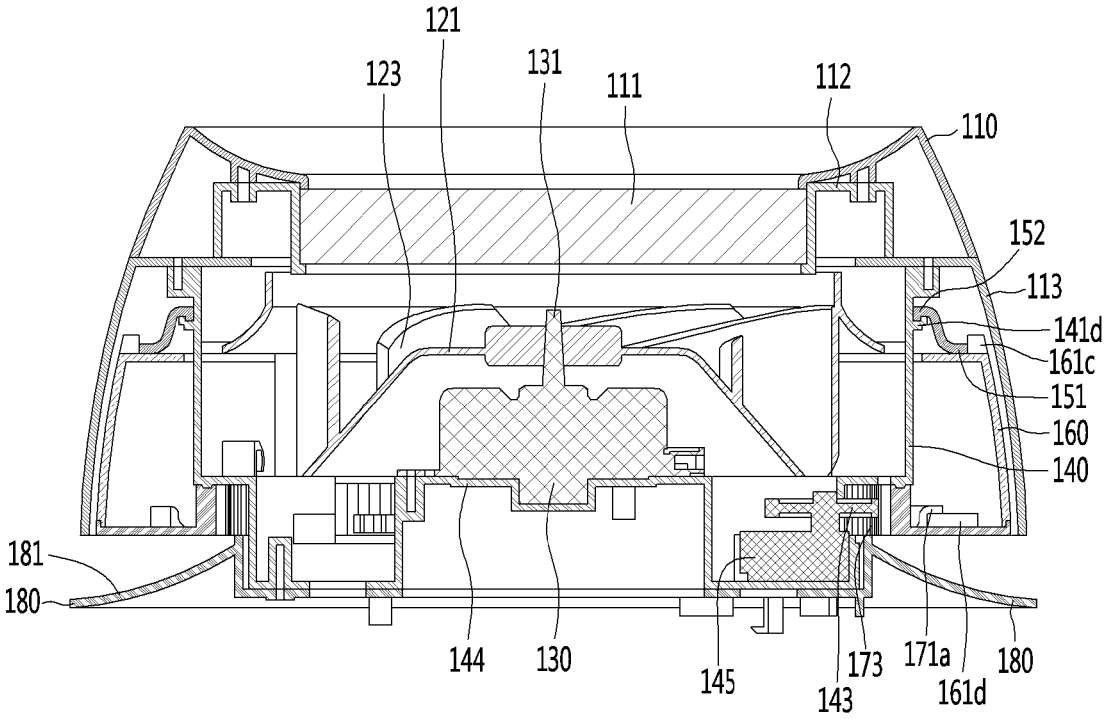
FIG. 8 is a sectional view of the first blower according to an embodiment.
Figure 9:
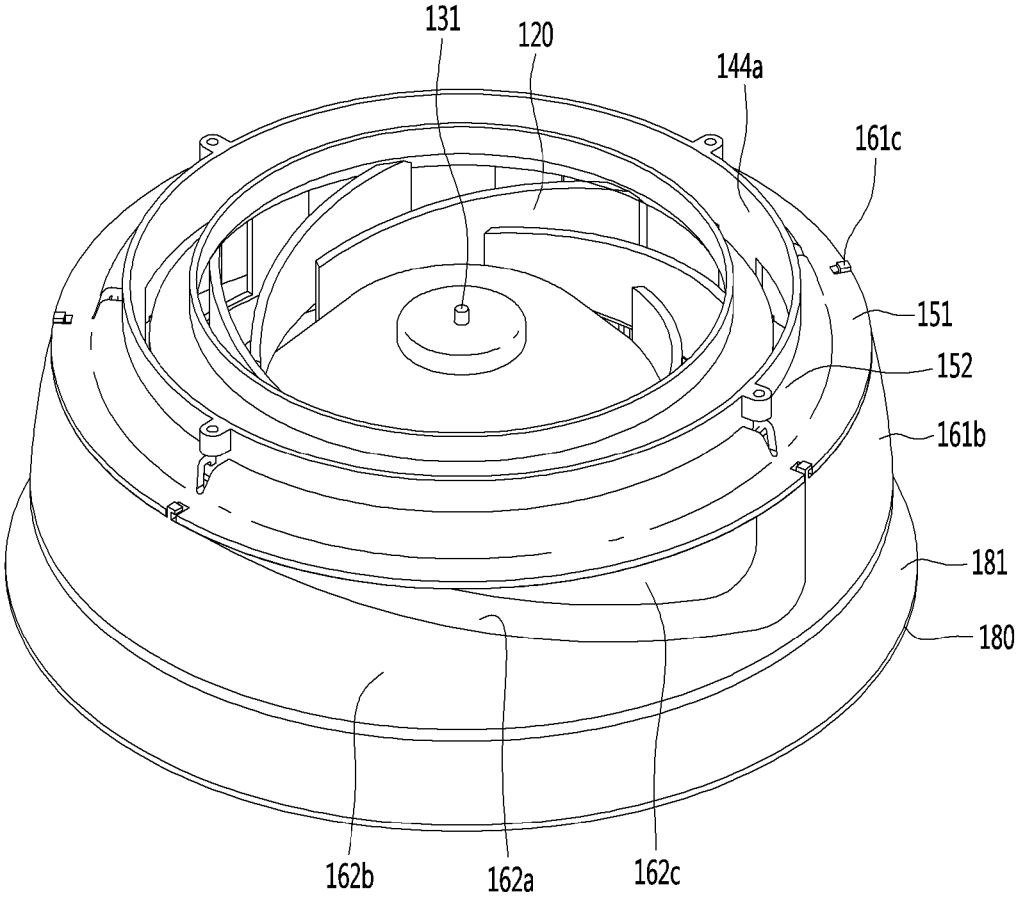
FIG. 9 is a perspective view illustrating when the first case and the upper suction inlet are removed from the first blower according to an embodiment.

FIG. 3 is a sectional view of the body of the blower according to an embodiment. FIG. 4 is an exploded view of the first blower according to an embodiment. FIG. 5 is an exploded view of an upper suction inlet and a first case according to embodiment. FIG. 6 is an exploded view of a first flow generating fin according to an embodiment. FIG. 7 is an exploded view of a first discharge guide according to an embodiment. FIG. 8 is a sectional view of the first blower according to an embodiment. FIG. 9 is a perspective view illustrating when the first case and the upper suction inlet are removed from the first blower according to an embodiment.

Referring to FIGS. 3 to 9, the body 10 may include the first blower 100 and the second blower 200 as described above. The first blower 100 may suction air from the upper side of the body and discharge the suctioned air at the lower end thereof in the first discharge direction.

The first blower 100 may include an upper suction part or inlet 110 which may be provided at an upper portion of the first blower 100 to enable indoor air at an upper side thereof to be suctioned therethrough. The upper suction inlet 110 may include a first suction opening 110*a* which may be formed in an approximately ring shape to allow air to be suctioned therethrough. In addition, an upper portion of the upper suction inlet 110 may have a diameter smaller than a diameter of a lower portion of the upper suction inlet 110. That is, the upper suction inlet 110 may have a truncated cone shape.

A height of an outer circumferential surface of the upper suction inlet 110 may be greater than a height of an inner circumferential surface of the upper suction inlet 110. That is, an extension line extending from the outer circumferential surface to the inner circumferential surface of the upper suction inlet 110 may be rounded downward. Accordingly, air at an upper side of the first blower 100 may flow along a rounded inclined surface of the upper suction inlet 110, and thus, a suction force of the upper suction inlet 110 may be increased.

A filter mounting part or mount 112 having a filter 111 mounted thereto may be provided at an inner circumferential surface of the upper suction inlet 110. The filter mount 112 may have an approximately ring shape, and a filter mounting opening may be formed at a central portion of the filter mount 112. A size of the filter mounting opening may be approximately equal to a size of the first suction opening 110*a* of the upper suction inlet 110.

The filter 111 may have a circular shape having a diameter corresponding to a diameter of the filter mounting opening, to be inserted and coupled into the filter mounting opening. In other words, the filter 111 may be provided in the first suction opening 110*a*, and air introduced through the upper suction inlet 110 may be filtered by the filter 111, so that fine dust or foreign substances in the air may be filtered. A kind of the filter 111 is not limited.

A plurality of first protruding ribs 112*a* protruding in a radial direction from a center of the filter mount 112 may be formed at an outer circumferential surface of the filter mount 112. The plurality of first protruding ribs 112*a* may be spaced apart from each other at a certain distance along the outer circumferential surface of the filter mount 112. The plurality of first protruding ribs 112*a* may each be coupled to a first bending rib 113*b* formed at an upper surface 113*a* of a first case 113, which will be described hereinafter.

The first blower 100 may further include the first case 113 which may be coupled to a lower portion of the upper suction inlet 110, thereby forming an outer appearance of the first blower 100. The first case 113 may have an approximately ring shape. An upper portion of the first case 113 may have a diameter equal to a diameter of the lower portion of the upper suction inlet 110. In addition, a lower portion of the first case 113 may have a diameter greater than a diameter of the upper portion.

The first case 113 may include the upper surface 113*a* and a lower surface, which may be formed to have a certain width between outer and inner circumferential surfaces thereof. A lower surface of the upper suction inlet 110 may be coupled to the upper surface 113*a* of the first case 113, so that the upper suction inlet 110 and the first case 113 may have an integrated shape. In addition, an extension line extending from an upper portion to a lower portion of the first case 113 may have a predetermined curvature.

A plurality of first bending ribs 113*b* may be formed at the upper surface 113*a* of the first case 113. The plurality of bending ribs 113*b* may be respectively coupled to the plurality of first protruding ribs 112*a* formed at the filter mount 112.

The first bending rib 113*b* may have a "¬" shape. To allow the filter mount 112 to be coupled to the first case 113, if the filter mount 112 is placed on the upper surface 113*a* of the first case 113 and then rotated, the first protruding rib 112*a* may be coupled to the first bending rib 113*b*.

A plurality of second protruding ribs 113*c* may be formed at the upper surface 113*a* of the first case 113, and a plurality of first coupling grooves to which the plurality of second protruding ribs 113*c* may be respectively coupled may be formed in the lower surface of the upper suction inlet 110. As the plurality of second protruding ribs 113*c* are respectively inserted and coupled into the plurality of first coupling grooves, the upper surface 113*a* of the case 113 and the lower surface of the upper suction inlet 110 may be coupled to each other.

A first flow generating part or may be provided at an inner circumferential surface of the first case 113. The first flow generating portion may be a means that generates a flow in which air is suctioned toward the upper suction inlet 110, and a flow in which air is discharged to a first discharge guide device or guide, which will be described hereinafter.

The first flow generating portion may include a rotating upper fan 120, an upper fan motor 130 that transfers a rotational force to the upper fan 120, and an upper fan housing 140 in which the upper fan 120 and the upper fan motor 130 may be accommodated. The upper fan motor 130 may be coupled to the upper fan housing 140 to transfer a drive to the upper fan 120. The upper fan motor 130 may include a rotational shaft coupled to the upper fan 120 to rotate the upper fan 120. The configuration of the upper fan motor 130 is not limited as long as the upper fan motor 130 is a motor generally coupled to a fan.

The upper fan 120 may be coupled to the upper fan motor 130 to be rotated. For example, the upper fan 120 may be a centrifugal fan by which air is introduced in an axial direction and discharged toward a lower side in the radial direction. The upper fan 120 may include a hub 121 coupled to a rotational shaft 131 of the upper fan motor 130, a shroud 122 spaced apart from the hub 121, and a plurality of blades 123 provided between the hub 121 and the shroud 122.

The hub 121 may have a bowl shape having a width which gradually narrows in an upward direction. Also, the hub 121 may include a shaft coupling part or portion 124 through which the rotational shaft 131 may be coupled to the hub 121, and a first blade coupling part or portion extending downward from the shaft coupling portion 124. The upper fan motor 130 may be provided in a lower internal space of the hub 121, and the rotational shaft 131 of the upper fan motor 130 may be coupled to the shaft coupling portion 124 of the hub 121.

The shroud 122 may include an upper end part or end provided with a shroud suction hole through which air passing through the upper suction inlet 110 may be suctioned, and a second blade coupling part or portion extending downwardly from the upper end. One or a first surface of each of the plurality of blades 123 may be coupled to the first blade coupling portion of the hub 121, and the other or a second surface of each of the plurality of blades 123 may be coupled to the second blade coupling portion of the shroud 122. The plurality of blades 123 may be spaced apart from each other in the circumferential direction of the hub 121.

Each blade 123 may include a leading edge that forms a side end portion or end at which air is introduced, and a trailing edge that forms a side end portion at which air is discharged. Air which is suctioned through the upper suction inlet 110 and passes through the filter 111*a* may flow downwardly, be introduced at the leading edge by flowing in the axial direction of the upper fan 120, and be discharged at the trailing edge via the blade 123. In this case, the trailing edge may be downwardly and outwardly inclined with respect to the axial direction, corresponding to the flow direction of the air, so that the air discharged by the trailing edge may flow downwardly at an incline in the radial direction.

The upper fan housing 140 may include a first coupling fan housing 142 in which the upper fan 120 and the upper fan motor 130 may be accommodated, and a first side fan housing 141 provided at an upper portion of the first coupling fan housing 142. An accommodating space 140*a* in which the upper fan 120 and the upper fan motor 130 may be accommodated may be defined by the first side fan housing 141 and the first coupling fan housing 142.

The first side fan housing 141 may include a ring-shaped first upper surface part or first upper surface 141*a* provided at an upper portion thereof, a ring-shaped first lower surface part or surface) 141*b* provided at a lower portion thereof, and a plurality of first extension parts or extensions 141*c* that extend between the first upper surface 141*a* and the first lower surface 141*b*. The first upper surface 141*a* may be formed in a ring shape to have a surface vertical to the ground. That is, the first upper surface 141*a* may have a cylindrical shape having open upper and lower ends.

A second bending rib 141*d* extending by a predetermined length in the circumferential direction may be provided at an outer circumferential surface of the first upper surface 141*a*. The second bending rib 141*d* may have a "ㄴ" shape that protrudes in an outer radial direction of the first upper surface 141*a* and is then bent upward. Also, the second bending rib 141*d* may extend in the circumferential direction of the first upper surface 141*a*. According to this configuration, a guide supporting device or support 150, which will be described hereinafter, may be rotated when coupled to the second bending rib 141*d* of the first upper surface 141*a*.

The first extension 141*c* may vertically extend toward the first lower surface 141*b* from the first upper surface 141*a*, and have a plate shape. Also, a plurality of the first extension 141*c* may be provided spaced apart from each other along the circumferential direction of the first side fan housing 141.

The lower surface 141*b* may include a first lower surface body formed in a ring shape to have a surface horizontal to the ground, and a first recessed part or first recess 141*e* recessed in the radial direction at an inner circumferential surface of the first lower surface body. A plurality of the first recess 141*e* may be provided spaced apart from each other at a certain distance in the circumferential direction of the first lower surface body.

The first coupling fan housing 142 may be connected to a lower portion of the first side fan housing 141, and have a cylindrical shape having an open upper portion. The first coupling fan housing 142 may include a first side surface part or surface 142*b*, a second lower surface part or surface 142*a*, and an upper fan motor coupling part or portion 144.

The first side surface 142*b* may extend downward from the first lower surface 141*b* of the first side fan housing 141. The first side surface 142*b* may have a ring shape having a surface vertical to the ground, and include a first side surface body extending downwardly from an inner circumferential surface of the first lower surface 141*b*, and a second recessed part or recess 142*c* recessed downwardly at an upper end of the first side surface part body.

A plurality of the second recess 142*c* may be provided spaced apart from each other at a certain distance along the circumferential direction of the first side surface body. The first recess 141*e* and the second recess 142*c* may vertically communicate with each other, to form a communicating space. Through the communicating space, a first pinion gear 143, which will be described hereinafter, may be partially exposed to an outside of the upper fan housing 140.

The first side surface body may include a first pinion gear coupling surface 142*d* extending from a lower end of the second recess 142*c*, to be coupled to the first pinion gear 143, which will be described hereinafter. The first pinion gear coupling surface 142*d* may have a surface parallel to the first lower surface body.

If the first pinion gear 143 is coupled to the first pinion gear coupling surface 142*d*, a portion of the first pinion gear 143 may protrude to an outside of the first side surface body of the upper fan housing 140 through the communicating space of the first recess 141*e* and the second recess 142*c*. The first pinion gear 143 may be coupled to the first pinion gear coupling surface 142*d*. The first pinion gear 143 may be engaged with a first rack gear 173 of a first discharge part or outlet 170, which will be described hereinafter. An operation of the first pinion gear 143 will be described hereinafter.

For example, three first recesses 141*e* and three second recesses 142*c* may be radially arranged based on a center of the upper fan housing 140. In this case, three first pinion gears 143 may also be provided. The three first pinion gears 143 may have a center identical to a center of a circle which is an upper end surface of the upper fan housing 140, and be provided at vertex positions of a regular triangle having vertices on a circumferential surface of the circle which is the upper end surface of the upper fan housing 140.

The second lower surface 142*a* may be connected to a lower end of the first side surface 142*b*, to form a lower surface of the upper fan housing 140. The upper fan motor coupling portion 144 may protrude upward from a central portion of the second lower surface 142*a*, and the upper fan motor 130 may be coupled to the upper fan motor coupling portion 144. A first gear motor 145 that transfers a drive force to rotate the first pinion gear 143 may be provided at the second lower surface 142*a*.

The first blower 100 may further include the first discharge guide provided between the first flow generating portion and the first case 113, to perform a rotary motion to guide the first air current A generated by the first flow generating portion and discharge the first air current A to the outside. The first discharge guide may include a first flow guide part or guide 160 that guides a flow of air generated by the first flow generating portion, and the first discharge outlet 170 provided at a lower side of the first flow guide 160 to discharge air guided by the first flow guide 160. The first discharge guide may be rotatably connected to the first flow generating portion, to be rotated in the circumferential direction.

The first flow guide 160 may have a ring shape. A diameter of an upper end of the first flow guide 160 may be smaller than a diameter of a lower end of the first flow guide 160. That is, the first flow guide 160 may have a truncated cone shape.

The first flow guide 160 may guide air discharged by the upper fan 120. The first flow guide 160 may include a first flow path part or path 161 that provides a path through which air generated by the first flow generating portion flows, and a first guide flow path 162 that guides a flow of air in an inclined lower direction from the first flow path 161.

The first flow path 161 may have a C shape in which a portion of the ring shape is cut out. The first flow path 161 may have a side surface 161*b* forming an outer appearance thereof and an upper surface 161*a* bent toward a center of the first flow guide 160 from an upper end of the side surface 161*b*. A flow path through which air may flow may be formed in a space between the side surface 161*b* and the upper surface 161*a* of the first flow path 161.

The first guide flow path 162 may be provided at the cut-out portion of the first flow path 161. The first guide flow path 162 may include a first inclined surface 162*a* inclined to be rounded downward from the upper surface 161*a* of the first flow path part 161, and a first guide connecting part or surface 162*b* that extends from the side surface 161*b* of the first flow path part 161 and is bent downward from a first end of the first inclined surface 162*a*. Also, the first guide flow path 162 may further include a second guide connecting part or surface 162*c* bent upwardly from the a second end of the first inclined surface 162*a*.

An inclined space formed by the first guide connecting surface 162*b*, the first inclined surface 162*a*, and the second guide connecting surface 162*c* may form an air flow path. That is, air flowing through the first flow path surface 161 may be guided to the first discharge outlet 170 through the flow path formed by the first guide connecting surface 162*b*, the first inclined surface 162*a*, and the second guide connecting surface 162*c*.

A third bending rib 161*c* may be formed at the upper surface 161*a* of the first flow path 161. The third bending rib 161*c* may be a component to which the guide supporting device 150, which will be described hereinafter may be coupled. The third bending rib 161*c* may have a "¬" shape, and may be provided at the upper surface 161*a* of the first flow path 161. A plurality of the third bending rib 161*c* may be provided, and the plurality of third bending ribs 161*c* may be spaced apart from each other at a certain distance along the circumferential direction of the first flow path 161.

A third protruding rib 161*d* protruding toward a center of the first flow path 161 may be formed at a lower end of the side surface 161*b* of the first flow path 161. The third protruding rib 161*d* may be a component to which a third flow path may be coupled. A plurality of the third protruding rib 161*d* may be provided, and the plurality of third protruding ribs 161*d* may be spaced apart from each other at a certain distance along the circumferential direction of the third flow path.

The first discharge outlet 170 may be provided at a lower side of the first flow guide 160, to discharge air guided from the first flow guide 160 to the outside. The first discharge outlet 170 may include a ring-shaped first discharge body 171 and the first rack gear 173 protruding upwardly from the first discharge body 171.

The first discharge body 171 may have a ring shape, and may include a first discharge port 172 formed to have a set or predetermined length in the circumferential direction. In this case, the predetermined length of the first discharge port 172 may be approximately equal to a length of the first guide flow path 162. Air guided through the first guide flow path 162 of the first flow guide 160 may be discharged downwardly through the first discharge port 172.

A fourth bending rib 171*a* may be formed at an upper surface of the first discharge body 171. The fourth bending rib 171*a* may be bent in a "¬" shape, and a plurality of the fourth bending rip 171*a* may be provided. The plurality of fourth bending ribs 171*a* may be spaced apart from each other at a certain or predetermined distance along the circumferential direction of the first discharge body 171. If the first flow guide 160 is mounted on the first discharge body 171 and then rotated, the third protruding rib 161*d* at the lower end of the side surface 161*b* of the first flow path 161 may allow the first flow guide 160 to be coupled to the first discharge outlet 170 while being inserted into the fourth bending rib 171*a* of the first discharge body 171.

The first guide flow path 162 of the first flow guide 160 and the first discharge port 172 may be arranged vertically, so that the first guide flow path 162 and the first discharge port 172 may communicate with each other. Accordingly, the air guided through the first guide flow path 162 may be discharged to the outside through the first discharge port 172.

The first rack gear 173 may have a ring shape protruding upward from an inner circumferential surface of the first discharge body 171. A plurality of sawteeth extending in the circumferential direction of the first rack gear 173 and protruding toward a center of the first discharge body 171 may be provided at an inner circumferential surface of the first rack gear 173.

The first discharge guide may further include the guide support 150 that supports the first flow guide 160. The guide support 150 may have an approximately ring shape. The guide support 150 may be coupled to the first flow guide 160 and the upper fan housing 140 to support the first flow guide 160 such that the first flow guide 160 may be connected to the upper fan housing 140.

The guide support 150 may include a mounting part or rim 151 mounted on the first flow guide part 160, and a coupling part or lip 152 that extends upwardly from the mounting rim 151 and has an end part or end bent downwardly to be coupled to the upper fan housing 140. The mounting rim 151 may have a ring shape, and may include a lower surface mounted on an upper surface of the first flow guide 160. Also, the mounting rim 151 may have a plurality of second coupling grooves 153 spaced apart from each other along the circumferential direction.

If the guide support 150 is rotated after the mounting rim 151 is mounted on the upper surface of the first flow guide 160 such that the third bending rib 161*c* is inserted into the second coupling groove 153, the guide support 150 may be coupled to the upper surface of the first flow guide 160 as at least one portion of the mounting rim 151 is inserted into the third bending rib 161*c*. The coupling rim 152 may have a ring shape, and may protrude upwardly from the inner circumferential surface of the mounting rim 151 and then bent downwardly.

One side portion of the bent coupling rim 152 may include a hook. If the coupling rim 152 is coupled to the second bending rib 141*d*, the guide support 150 may be coupled to the upper fan housing 140. As an extending direction of the coupling rim 152 and an extending direction of the second bending rib 141*d* form a circumferential direction, the coupling rim 152 may be rotated along with the second bending rib 141*d* when the first flow guide 160 is rotated.

The first blower 100 may have a shape where a diameter is larger toward a first or lower portion as compared to a second or upper portion thereof. Therefore, the first discharge guide may be separated downwardly or deviated from an original position. Accordingly, the first discharge guide may be rotatably coupled to the upper fan housing 140 using the guide support 150, so that it is possible to prevent the first discharge guide from being separated downwardly or being deviated from the original position.

The first blower 100 may further include a first air current changing device or fin 180 which may be provided at a lower side of the first discharge guide, to change the flow of air discharged from the first discharge guide to a lateral direction. The first air current changing fin 180 may have a ring shape, and an upper surface of the first air current changing fin 180 may include an inclined surface inclined downward toward the outside. Thus, the flow of air discharged downward from the first discharge guide may be changed to the lateral direction by the inclined surface of the first air current changing fin 180.

Hereinafter, a rotating configuration of the first discharge guide will be discussed.

Figure 10:
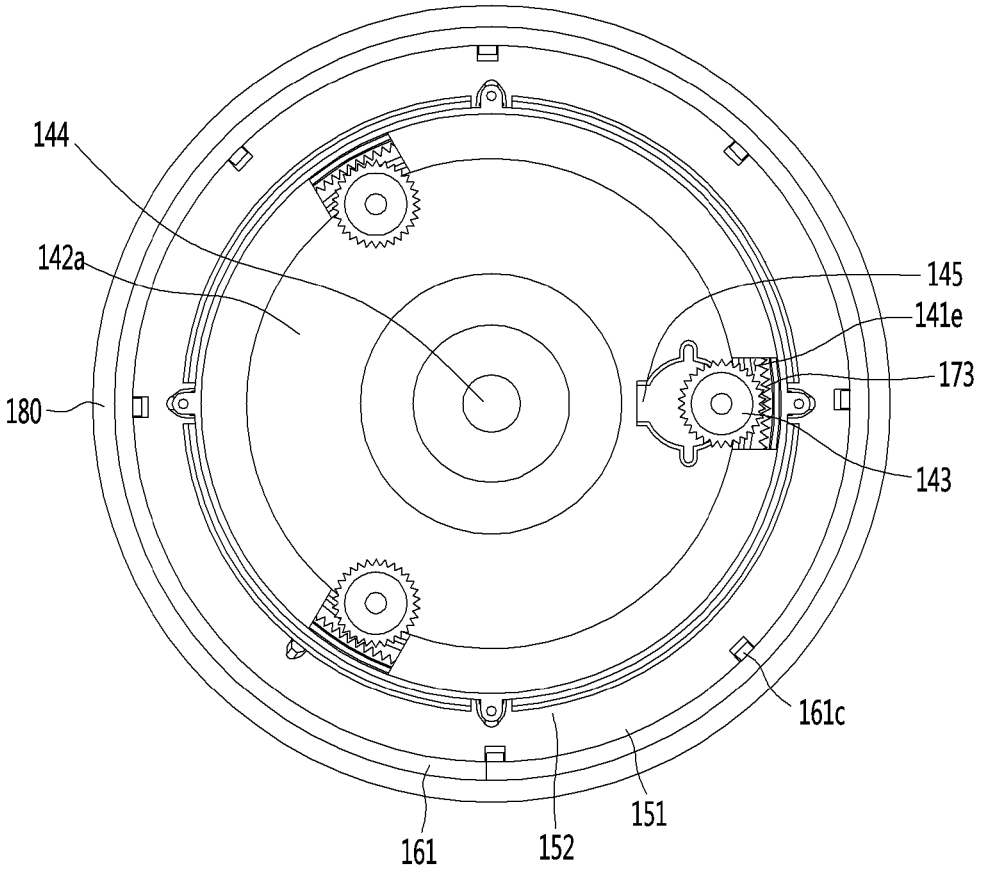
FIG. 10 is a top view showing a coupling state between a first pinion gear and a first rack gear of the first blower according to an embodiment.
Figure 11:
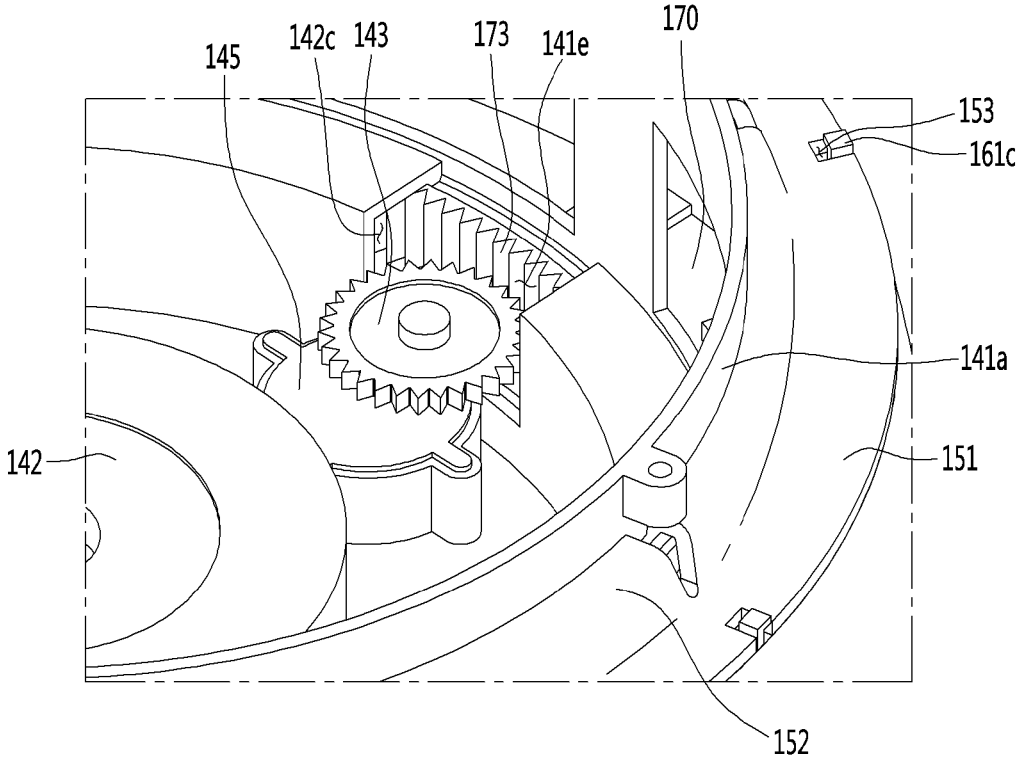
FIG. 11 is a perspective view showing the coupling state between the first pinion gear and the first rack gear of the first blower according to an embodiment.

FIG. 10 is a top view showing a coupling state between a first pinion gear and the first rack gear of a first blower according to an embodiment. FIG. 11 is a perspective view showing the coupling state between the first pinion gear and the first rack gear of the first blower according to the embodiment.

Referring to FIGS. 10 and 11, the plurality of first pinion gears 143 coupled to the upper fan housing 140 may be exposed to the outside of the upper fan housing 140 through the first recesses 141*e* and the second recesses 142*c*. In addition, if the first discharge guide is coupled to the upper fan housing 140, the first rack gear 173 among the components of the first discharge guide may be gear-coupled to the first pinion gear 143.

If the first pinion gear 143 is rotated as the first gear motor 145 coupled to any one of the plurality of first pinion gears 143 is driven, the first rack gear 173 may be rotated by the first pinion gear 143. As the first rack gear 173 is rotated, the first discharge outlet 170 may be rotated, and the first flow guide 160 coupled to the first discharge outlet 170 may also be rotated.

The first flow guide 160 and the first discharge outlet 170 may be rotated by 360 degrees in the circumferential direction. Accordingly, air introduced through the upper suction inlet 110 may be discharged in the lateral direction along the rotation direction of the first flow guide 160 and the first discharge outlet 170.

Figure 12:
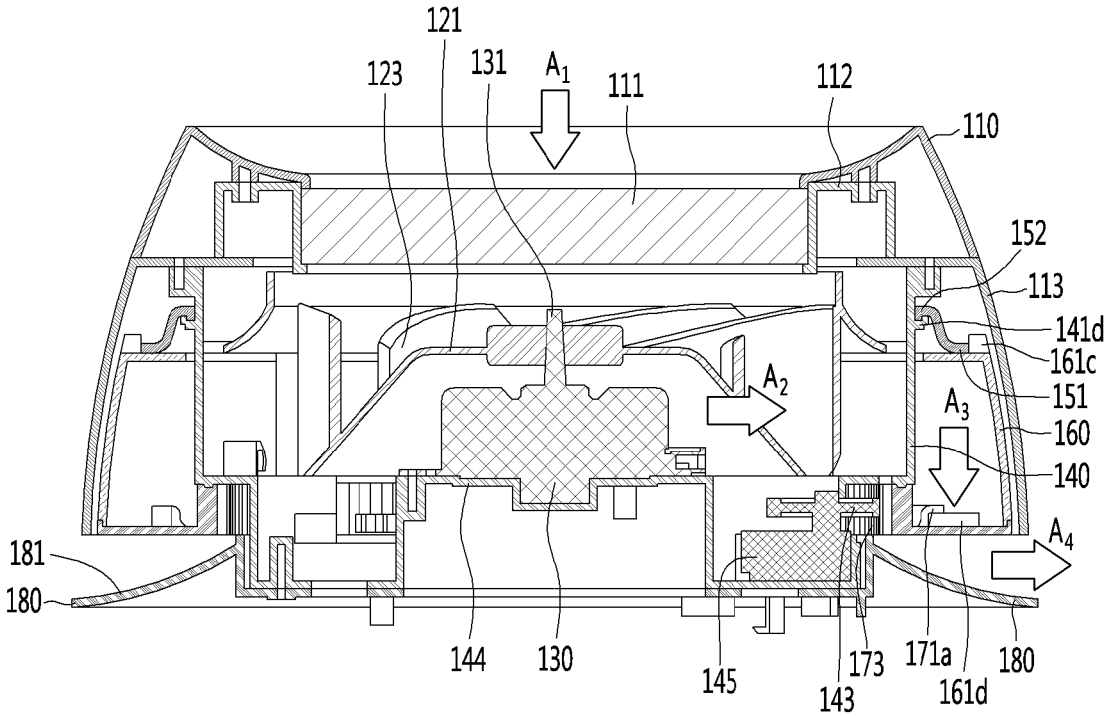
FIG. 12 is a side view showing a direction of a first air current flowing in the first blower according to an embodiment.
Figure 13:
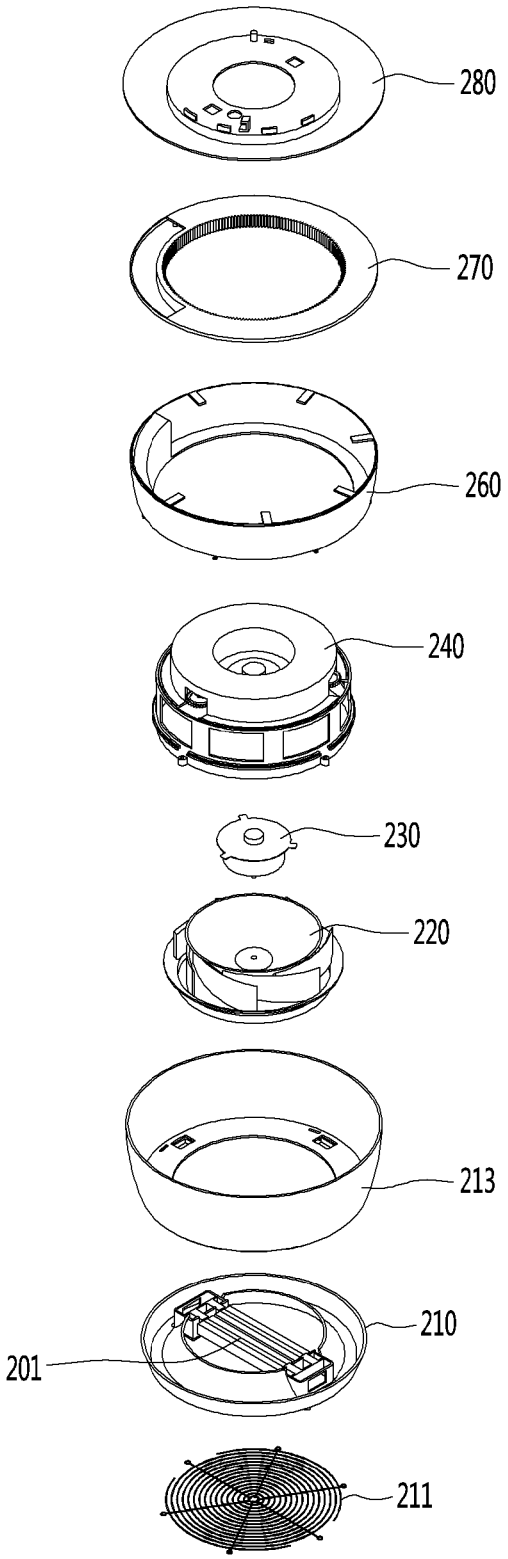
FIG. 13 is an exploded view of a second blower according to an embodiment.
Figure 14:
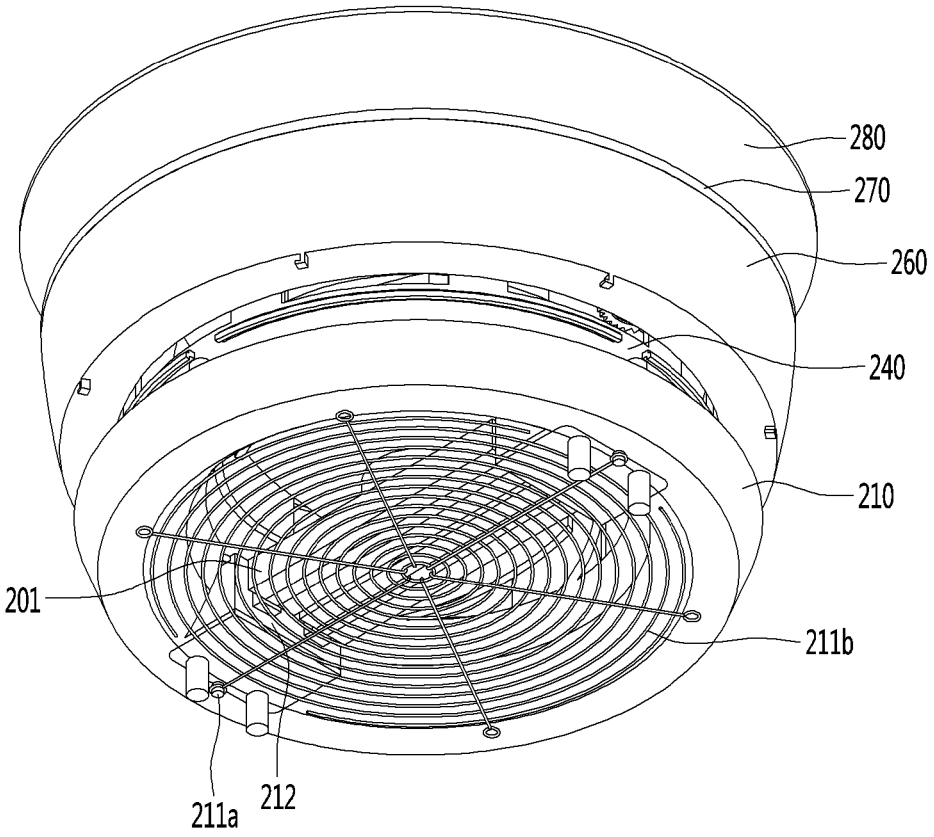
FIG. 14 is a perspective view illustrating when a second case is removed from the second blower.
Figure 15:
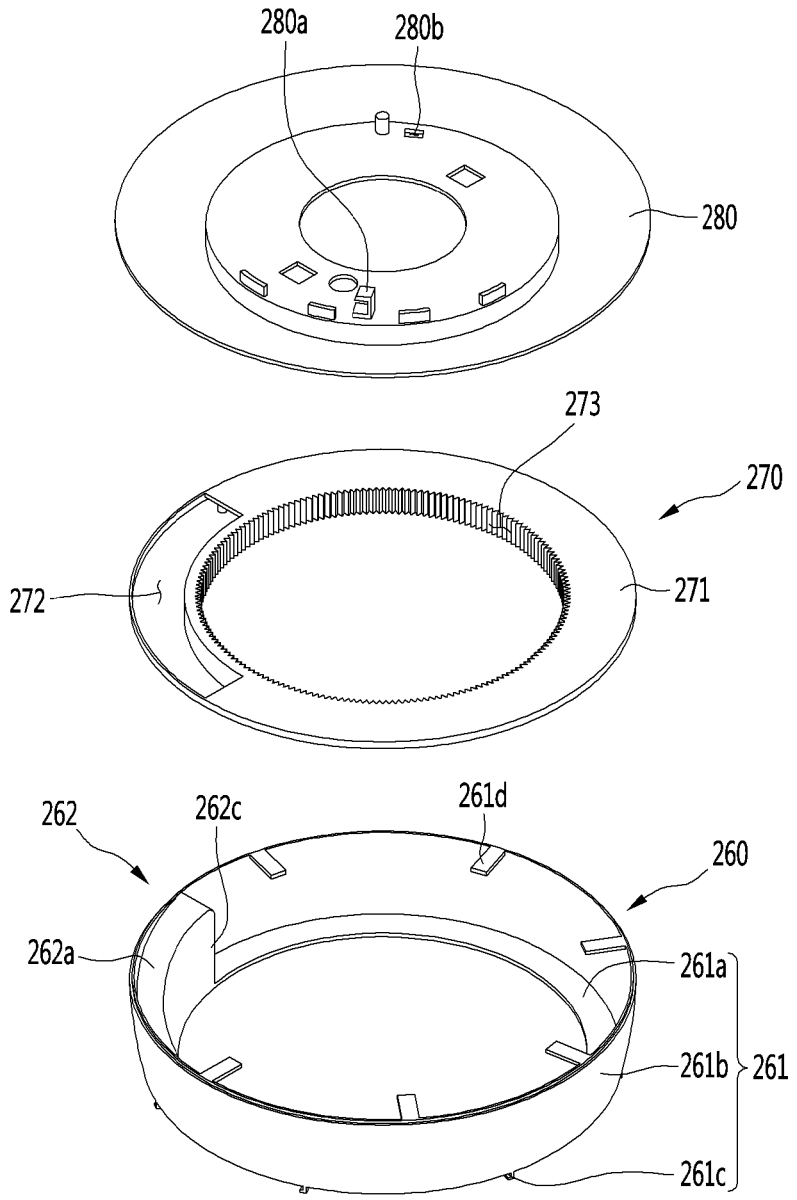
FIG. 15 is an exploded view of a second discharge guide and a second air current changing fin according to an embodiment.
Figure 16:
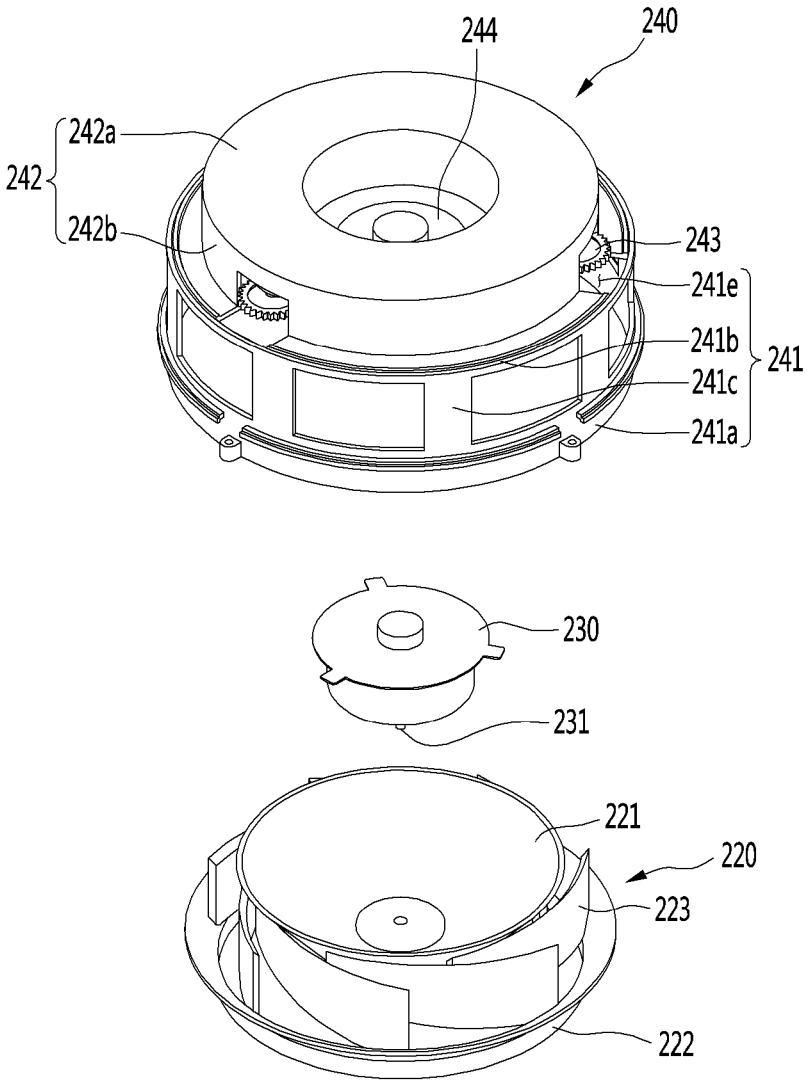
FIG. 16 is an exploded view of a second flow generating fin according to an embodiment.
Figure 17:
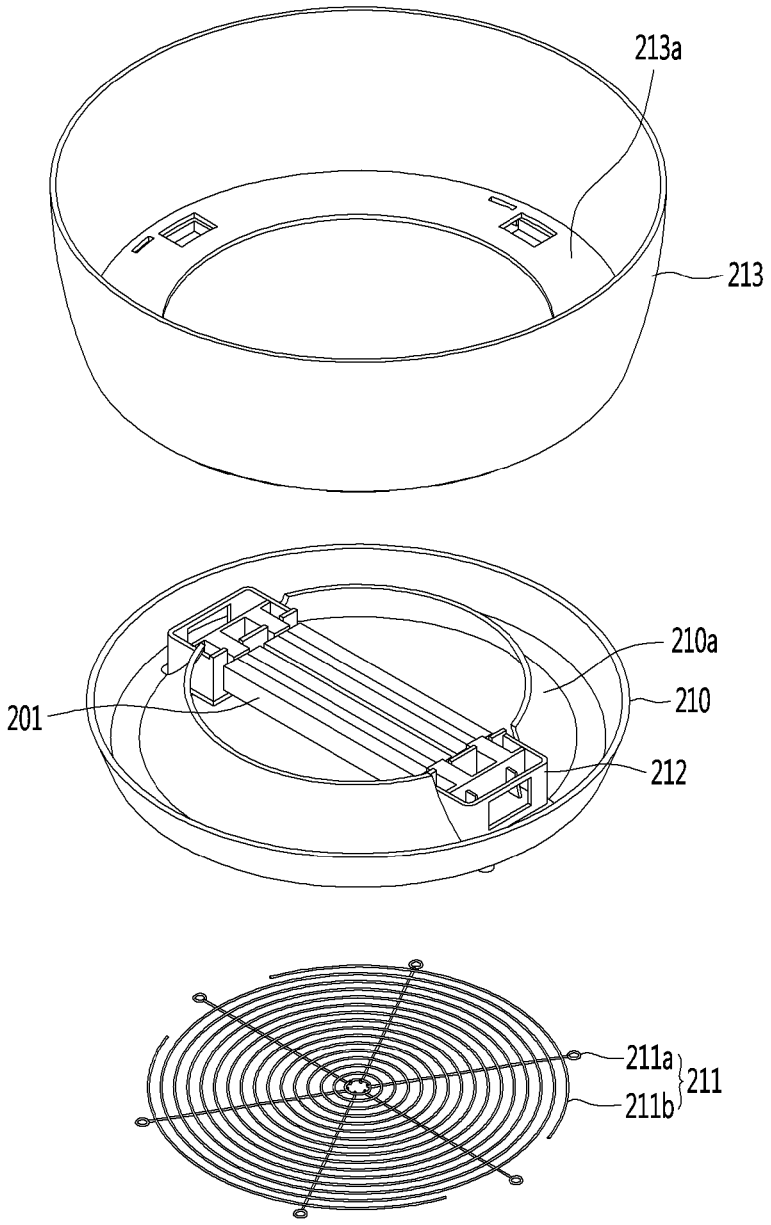
FIG. 17 is an exploded perspective view of a lower suction inlet and the second case according to an embodiment.
Figure 18:
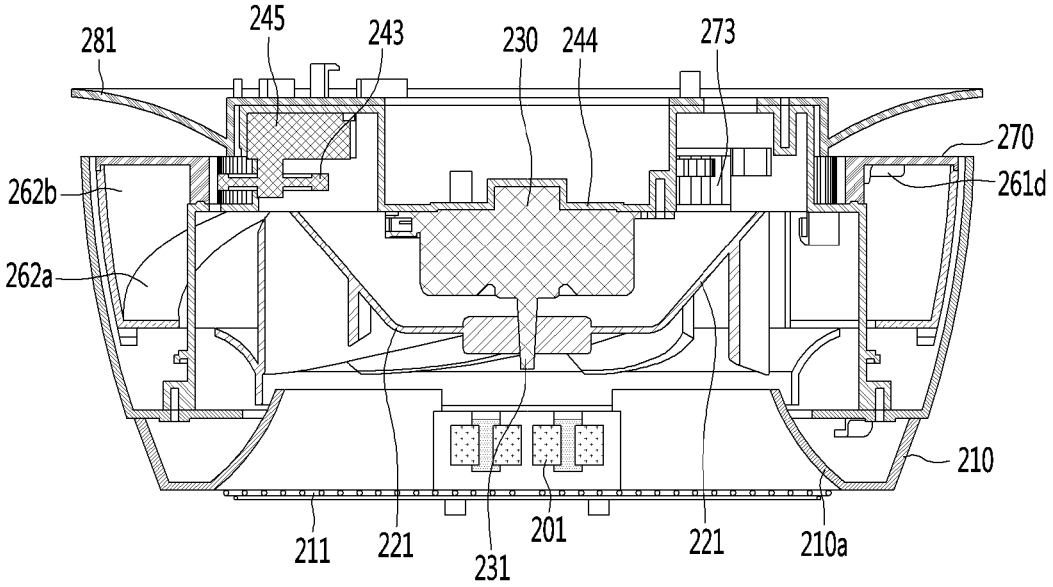
FIG. 18 is a sectional view of the second blower according to an embodiment.

Referring to FIG. 12, the first air current A generated in the first blower 100 may include a first flow A1, a second flow A2, a third flow A3, and a fourth flow A4. If the first blower 100 is operated, air may be suctioned through the upper suction inlet 110 along the first air current A and then discharged in the first discharge direction by a first suction discharge outlet and the first air current changing fin 180.

The first air current A will be described hereinafter. If the first blower 100 is operated, air at an upper side of the first blower 100 may flow toward the upper fan 120 through the upper suction inlet 110. A flow of the air flowing toward the upper fan 120 from the upper suction inlet 110 may be defined as the first flow A1.

The air reaching the upper fan 120 along the first flow A1 may flow in an outer radial direction as the upper fan 120 is rotated. The air reaching the upper fan 120 may flow in an outer downward radial direction of the upper fan 120. A flow of the air may be defined as the second flow A2. The air flowing along the second flow A2 may be suctioned through the shroud 122 of the upper fan 120 and then flow in the outer downward radial direction of the first flow guide 160 through the plurality of blades 123.

As the upper fan 120 is a centrifugal fan, air may flow in the radial direction. As the trailing edge of the upper fan 120 is inclined in the outer downward direction with respect to the axial direction, the air suctioned through the shroud 122 may be introduced into the leading edge of the plurality of blades 123 and then flow in the outer downward radial direction while passing through the trailing edge. The air guided by the first flow guide 160 along the second flow A2 may flow in the downward direction through the first discharge outlet 170. A flow of the air may be defined as the third flow A3.

The direction of the air discharged in the downward direction from the first discharge outlet 170 along the third flow A3 may be changed from the downward direction to a lateral direction by the first air current changing fin 180 to be discharged to the outside. A flow of the air may be defined as the fourth flow A4, and a direction of the air discharged to the outside through the fourth flow A4 may be defined as the first discharge direction.

In other words, as the first blower 100 is operated, the first air current A may form the first flow A1 along which air flows in the downward direction, the second flow A2 along which the air flows in the outer downward radial direction, the third flow A3 along which the air again flows in the downward direction, and the fourth flow A4 along which the air flows in the lateral direction and is then discharged to the outside. The air may be discharged in the first discharge direction by the first air current A.

Hereinafter, the second blower 200 will be described. The second blower 200 may have a shape obtained by overturning the first blower 100. That is, while the first blower 100 may have a truncated cone shape where a diameter is larger toward the lower portion compared to the upper portion thereof, the second blower 200 may have a truncated cone shape where a diameter is larger toward an upper portion from a lower portion thereof.

Referring to FIGS. 13 to 18, the second blower 200 may include a second suction inlet, which may also be referred as a lower suction part or inlet 210, a second flow generating part or portion, a second flow guide part or guide 260, and a second air current changing device or fin 280. The second blower 200 may suction air at the lower side of the body 10 and discharge the suction air at an upper end of the second blower 200 in the second discharge direction.

The lower suction inlet 210 may be provided at a lower portion of the second blower 200, and indoor air may be suctioned through the lower suction inlet 210. The lower suction inlet 210 may have an approximately ring shape, and include a second suction opening through which air is suctioned. A lower portion of the lower suction inlet 210 may have a diameter smaller than a diameter of an upper portion of the lower suction inlet 210.

A height of an outer circumferential surface of the lower suction inlet 210 may be greater than a diameter of an inner circumferential surface of the lower suction inlet 210. An extension surface 210*a* extending from the outer circumferential surface to the inner circumferential surface of the lower suction inlet 210 may be formed to be rounded upward.

A heater 201 may be provided at the extension surface 210*a* of the lower suction part 210. Heater mounting parts or mounts 212 that allow the heater 201 to be coupled thereto may be formed at the extension surface 210*a* of the lower suction part 210.

The heater mounts 212 may be provided at a first side and a second side of the extension surface 210*a*, to support both ends of the heater 201, respectively. Insertion grooves in to which both the ends of the heater 201 may be inserted may be formed in the heater mounts 212, respectively. However, this is merely an example of the coupling, and the coupling is not limited as long as the heater 201 may be coupled to the heater mounts 212.

The heater 201 may have a bar shape, and both ends of the heater 201 may be coupled to the insertion grooves of the heater mounts 212, respectively. In this case, the heater 201 may be understood as a heat source that selectively heats air introduced through the lower suction inlet 210, and a kind of the heater 201 is not limited.

A grill 211 may be provided in the second suction opening of the lower suction inlet 210. The grill 211 may radially extend from the center of the lower suction part 210. The grill 211 may include a plurality of first grills 211*a* coupled to a lower surface of the lower suction inlet 210, and a plurality of circular second grills 211*b* connected to the plurality of first grills 211*a*.

The grill 211 may be formed of a metallic material. The grill 211 may be heated together with the heater, to uniformly heat air introduced into the lower suction inlet 210. As the heater and the grill 211 are provided at the lower suction inlet 210, the user may not drive the heater in hot weather, such as in summer, to enable cool air to be discharged, and may drive the heater in cold weather, such as winter, to enable warm air to be discharged.

A second case 213 may be connected to an upper portion of the lower suction inlet 210 to form an appearance of the second blower 200. The second case 213 may have an approximately ring shape, and a lower diameter of the second case 213 may be approximately equal to an upper diameter of the lower suction inlet 210. An upper portion of the second case 213 may have a diameter greater than a diameter of a lower portion of the second case 213. The second case 213 may have a shape obtained by overturning the first case 113. An extension line extending from the upper portion to the lower portion along an outer edge of the second case 213 may have a predetermined curvature.

The second flow generating portion may be provided at an inner circumferential surface of the second case 213. The second flow generating portion may generate a flow pattern by which air is suctioned toward the lower suction inlet 210 and the second air current B discharged to a second discharge guide, which will be described hereinafter.

The second flow generating portion may have a shape obtained by overturning the first flow generating portion. The second flow generating portion may include a rotating lower fan 220, a lower fan motor 230 that transfers a rotational force to the lower fan 220, and a lower fan housing 240 in which the lower fan 220 and the lower fan motor 230 may be accommodated.

The lower fan motor 230 may include a rotational shaft coupled to the lower fan housing 240, and may transfer a drive force to the lower fan 220. A configuration of the lower fan motor 230 may be similar to a configuration of the upper fan motor 130, and therefore, detailed description thereof has been omitted.

The lower fan 220 may be rotatably coupled to the lower fan motor 230. For example, the lower fan 220 may include a centrifugal fan that receives air in an axial direction and discharges the air to an upper side in the radial direction.

The lower fan 220 may include a hub 221 coupled to the rotational shaft of the lower fan motor 230, a shroud 222 spaced apart from the hub 221, and a plurality of blades 223 provided between the hub 221 and the shroud 222. A configuration of the lower fan 220 may be similar to a configuration of the upper fan 120, and therefore, detailed description thereof has been omitted.

Air passing through the heater from a lower side through the lower suction inlet 210 may flow in the axial direction of the lower fan 220 while flowing upwardly, and may flow toward an upper side in the radial direction via the plurality of blades 223. The lower fan housing 240 may include a second coupling fan housing 242 in which the lower fan 220 and the lower fan motor 230 may be accommodated, and a second side fan housing 241 provided at a lower portion of the lower fan housing 240.

The second coupling fan housing 241 may have a structure identical to that obtained by overturning the first coupling fan housing 142, and the second side fan housing 241 may have a structure identical to that obtained by overturning the first side fan housing 141. In addition, an accommodating space in which the lower fan 220 and the lower fan motor 230 may be accommodated may be defined by the second coupling fan housing 242 and the second side fan housing 241.

The second coupling fan housing 242 may include a second upper surface part or surface 242*a*, a second side surface part or surface, and a lower fan motor coupling part or portion 244. The second upper surface 242*a*, the second side surface, and the lower fan motor coupling portion 244 may have structures identical to those obtained by overturning the second lower surface 142*a*, the first side surface 142*b*, and the upper fan motor coupling 144 of the first coupling fan housing 142, respectively, and therefore, repetitive descriptions have been omitted.

The second side fan housing 241 may include a third upper surface part or surface 241*b*, a third lower surface part or surface 241*a*, and a second extension part or extension 241*c*. The third upper surface 241*b*, the third lower surface 241*a*, and the second extension 241*c* may have structures identical to those obtained by overturning the first lower surface 141*b*, the first upper surface 141*a*, and the first extension 141*c* of the first side fan housing 141, respectively, and therefore, repetitive descriptions have been omitted.

However, for convenience of description, a second pinion gear 243 may be provided at a position of the lower fan housing 240, corresponding to a position of the upper fan housing 140, at which the first pinion gear 143 is provided. A second gear motor 245 that drives the second pinion gear 243 may be connected to the second pinion gear 243.

The second blower 200 may further include a second discharge guide device or guide provided between the second flow generating portion and the second case 213, and that performs a rotary motion to guide the flow of air generated by the second flow generating portion and discharge the air to the outside. The second discharge guide may include the second flow guide 260 which guides a flow of air generated by the second flow generating portion, and a second discharge part or outlet 270 provided at an upper side of the second flow guide 260 to discharge the guided air to the outside. The second discharge guide may be rotatable along the circumferential direction.

Shapes of the second flow guide 260 and the second discharge outlet 270 may be identical to those obtained by overturning the first flow guide 160 and the first discharge outlet 170. The second flow guide 260 may include a second flow path part or path 261 and a second guide flow path 262. The second flow path 261 and the second guide flow path 262 may have structures identical to those obtained by overturning the first flow path 161 and the first guide flow path 162, and therefore, repetitive descriptions have been omitted.

The second discharge outlet 270 may include the second discharge body 271 having the second discharge port 272 formed therein and a second rack gear 273. The second discharge body 271 and the second rack gear 273 may have structures identical to those obtained by overturning the first discharge body 171 and the first rack gear 173, respectively, and therefore, repetitive descriptions have been omitted.

The second discharge guide may not include components of the guide support 150 among the components of the first discharge guide. This is because, while an entire appearance of the first blower 100 has a shape where the diameter is larger at a lower portion compared to an upper portion of the first blower 100, an entire appearance of the second blower 200 has a shape where the diameter is smaller at a lower portion compared to an upper portion of the second blowing device 200. Hence, the second flow guide 260 in the second blower 200 may not be separated downward, and thus, it is unnecessary to support the second flow guide 260.

The second blower 200 may further include the second air current changing fin 280 provided at an upper side of the second discharge guide, to change the flow of air discharged from the second discharge guide to a lateral direction. The second air current changing fin 280 may have a ring shape, and a lower surface of the second air current changing fin 280 may include an inclined surface extending upward toward the outside. The flow direction of air discharged upward from the second discharge guide may be changed to the lateral direction by the inclined surface of the second air current changing fin 280.

A lower surface of the first air current changing fin 180 and an upper surface of the second air current changing fin 280 may be coupled to each other. An upper surface of the first air current changing fin 180 and a lower surface of the second air current changing fin 280 may be coupled by insertion coupling between a rib and a groove.

As the first air current changing fin 180 and the second air current changing fin 280 are coupled to each other, the first blower 100 and the second blower 200 may constitute one device. The first air current changing fin 180 and the second air current changing fin 280 may be commonly referred to as "air current changing fins."

Hereinafter, a rotating configuration of the second discharge guide device will be described.

Figure 19:
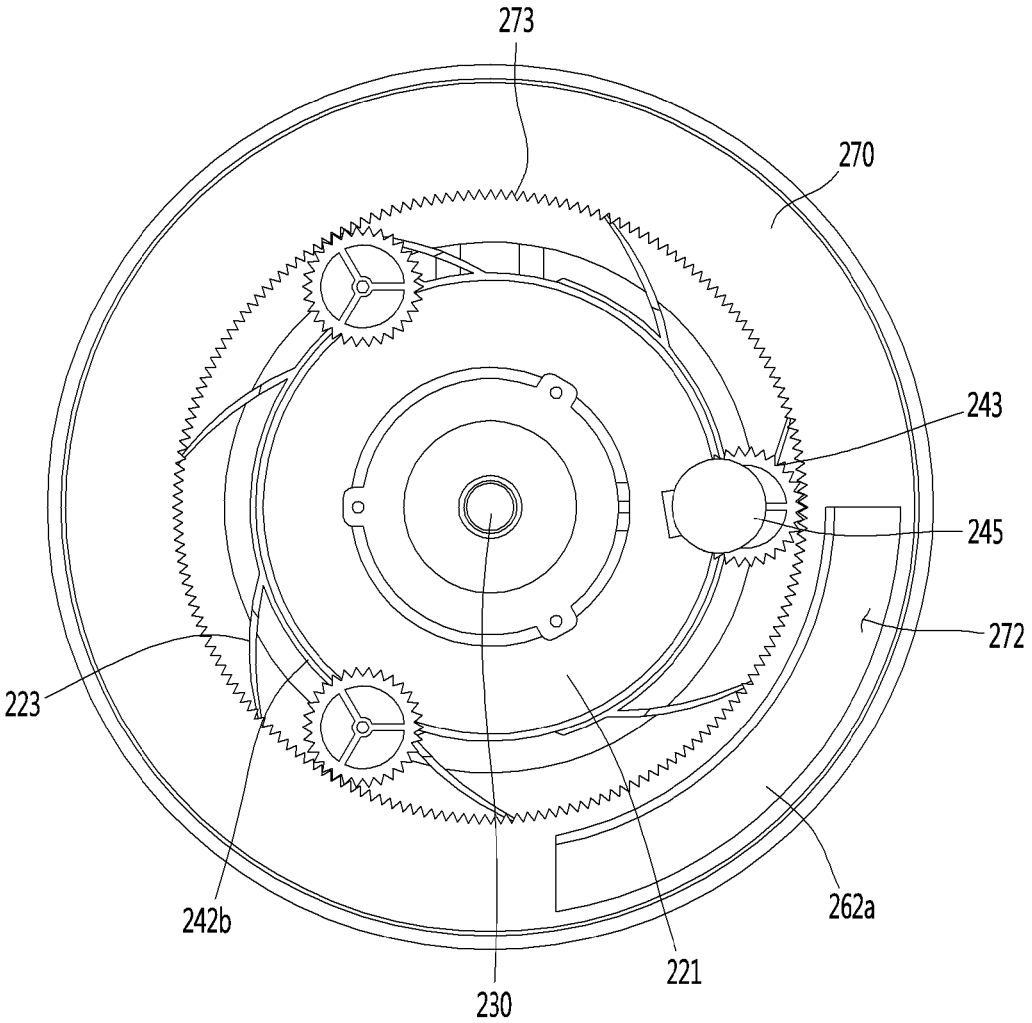
FIG. 19 is a top view showing a coupling state between a second pinion gear and a second rack gear of the second blower according to an embodiment.
Figure 20:
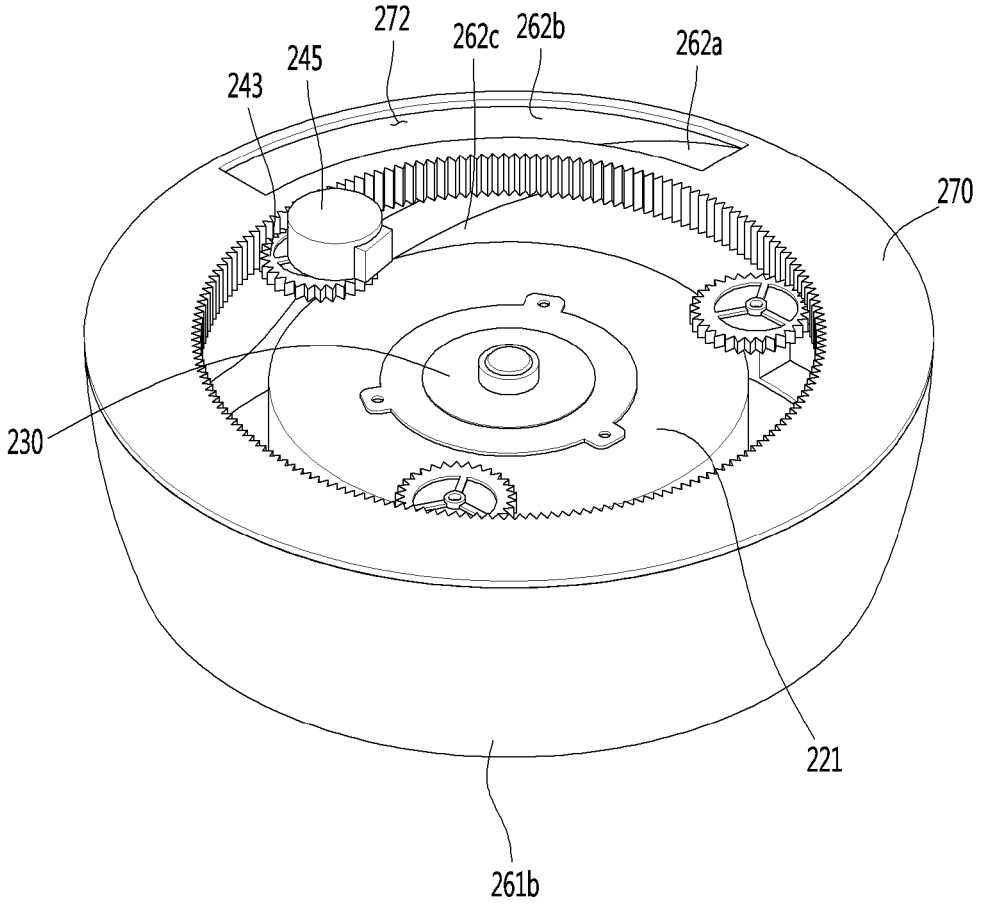
FIG. 20 is a perspective view showing the coupling state between the second pinion gear and the second rack gear of the second blower according to the embodiment.

FIG. 19 is a top view showing a coupling state between the second pinion gear and the second rack gear of the second blower according to an embodiment. FIG. 20 is a perspective view showing the coupling state between the second pinion gear and the second rack gear of the second blower according to the embodiment.

Referring to FIGS. 19 and 20, some of the plurality of second pinion gears 243 coupled to the lower fan housing 240 may be exposed to the outside of the lower fan housing 240. If the second discharge guide is coupled to the lower fan housing 240, the second rack gear 273 may be gear-coupled to the second pinion gear 243.

If the second pinion gear 243 is rotated as the first gear motor 145 coupled to any one of the plurality of second pinion gears 243 is driven, the second rack gear 273 may be rotated by the second pinion gear 243. As the second rack gear 273 is rotated, the second discharge outlet 270 may be rotated, and the second flow guide 260 coupled to the second discharge outlet 270 may also be rotated.

The second flow guide 260 and the second discharge outlet 270 may be rotated by 360 degrees in the circumferential direction. Accordingly, air introduced through the lower suction inlet 210 may be discharged in the lateral direction along the rotation direction of the second flow guide 260 and the second discharge outlet 270.

Figure 21:
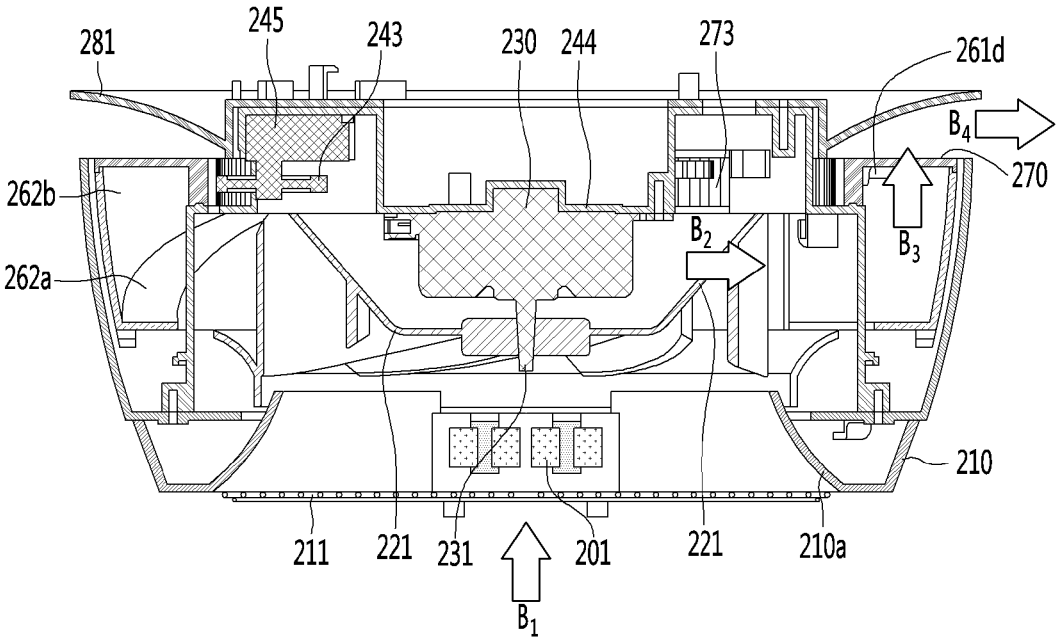
FIG. 21 is a side view showing a direction of a second air current flowing in the second blower according to an embodiment.

Referring to FIG. 21, the second air current B generated in the second blower 200 may include a fifth flow B1, a sixth flow B2, a seventh flow B3, and an eighth flow B4. If the second blower 200 is operated, the second air current B generated. Air may be suctioned through the lower suction inlet 210 and then discharged in the second discharge direction by the second discharge outlet 270 and the second air current changing fin 280.

If the second blower 200 is operated, air at a lower side of the second blower 200 may flow vertically in the upward direction and then flow toward the lower fan 220. A flow of the air flowing toward the lower fan 220 from the lower suction inlet 210 may be defined as the fifth flow B1.

The air reaching the lower fan 220 along the fifth flow B1 may flow in an outer upward radial direction as the lower fan 220 is rotated. A flow of the air may be defined as the sixth flow B2.

The air forming the fifth flow B1 may be suctioned through the shroud of the lower fan 220 and then may flow toward the second discharge guide in the outer upward radial direction through the blade. As the lower fan 220 is a centrifugal fan, air may flow in the radial direction. As the trailing edge of the lower fan 220 is inclined in the outer upward direction with respect to the axial direction, the air suctioned through the shroud may be introduced into the leading edge of the blade and then flow in the outer downward radial direction while passing through the trailing edge.

In other words, as the second blower 200 is operated, the second air current B may form the fifth flow B1 along which air flows in the upward direction, the sixth flow B2 along which the air flows in the outer upward radial direction, the seventh flow B3 along which the air again flows in the upward direction, and the eighth flow B4 along which the air flows in the lateral direction and is then discharged to the outside.

Figure 22:
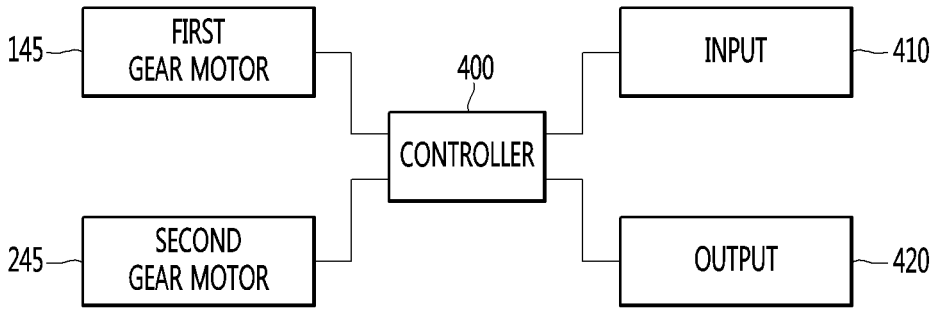
FIG. 22 is a conceptual view illustrating a connection configuration of a controller of the blower according to an embodiment.

Referring to FIG. 22, the blower according to the embodiment may include a controller 400 that controls a driving of the first gear motor 145 and the second gear motor 245, an input unit or input 410 that receives an input on an operation mode from a user, and an output unit or output 420 that outputs the operation mode received from the user to the outside. The user may input a command for an operation mode of the blower, using the input 410.

For example, the operation mode of the blower may include a concentrated air current control mode and a distributed air current control mode. When the blower is operated in the concentrated air current control mode or the distributed air current control mode, the user may determine whether a direction of air blown from the blower is to be changed.

The controller 400 may receive an input signal from the input 410, and control the driving of the first gear motor 145 and the second gear motor 245 such that the blower may perform an operation corresponding to the input signal. A rotational direction or speed of the first rack gear 173 engaged with the first pinion gear 143 and the second rack gear 273 engaged with the second pinion gear 243 may be controlled by the driving of the first gear motor 145 and the second gear motor 245.

The controller 400 may control the rotational speed and rotational direction of the first gear motor 145 and the rotational speed and the rotational direction of the second gear motor 245. For example, the controller 400 may control a number of revolutions of the first gear motor 145 and a number of revolutions of the second gear motor 245 so as to control the rotational speed of the first gear motor 145 and the a second gear motor 245.

The controller 400 may control driving of the upper fan motor 130 and the lower fan motor 230 such that the blower may perform an operation, for example, an operation in a rotation mode, corresponding to the input signal. In other words, as the controller 400 controls the driving of the upper fan motor 130 and the lower fan motor 230, the blower may generate an air flow to discharge air to the outside by controlling rotation of the upper fan 120 and the lower fan 220.

The output 420 may output information on a mode input from the input 410 to the outside. For example, when the user inputs the concentrated air current control mode through the input 410, the output 420 may output, to the outside, that the blower is being operated in the concentrated air current control mode. Thus, the user may identify a current operation mode of the blower from the outside with the naked eye.

Figure 23:
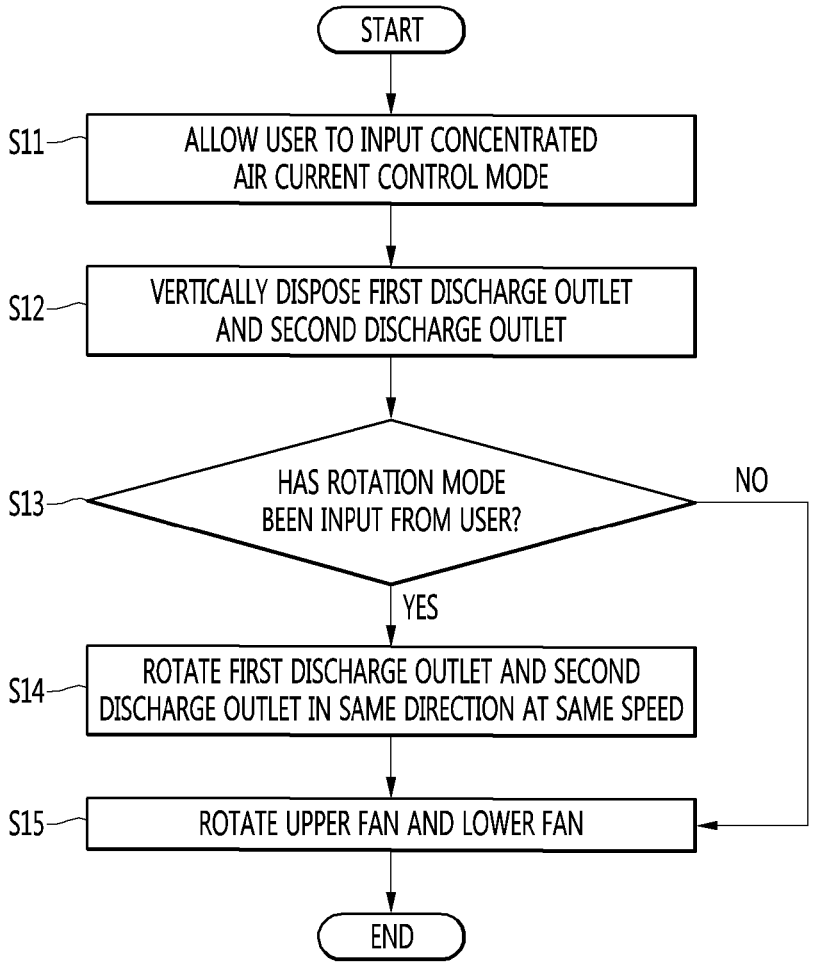
FIG. 23 is a flowchart illustrating a concentrated air current control mode method of the blower according to an embodiment.
Figure 24:
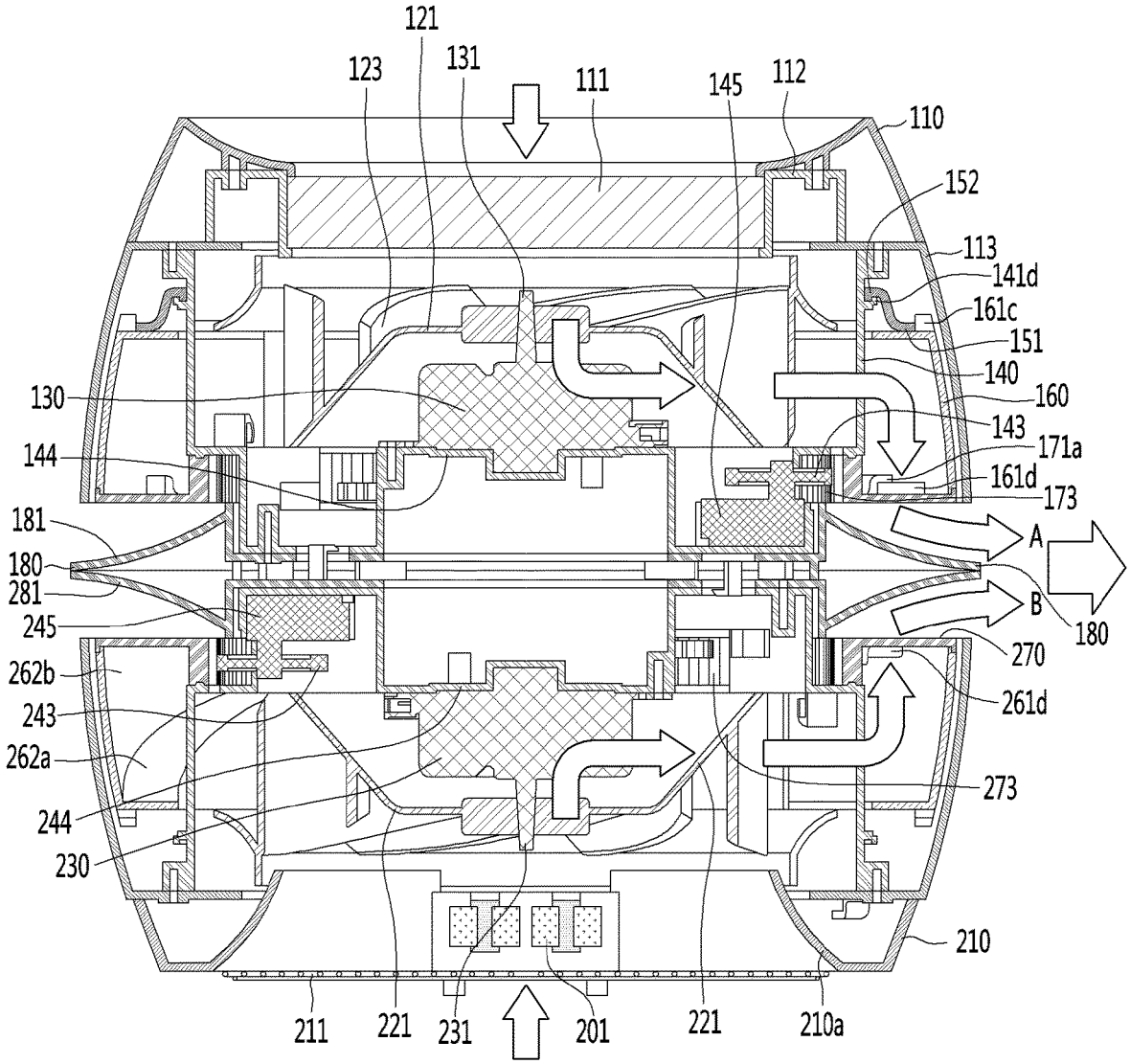
FIG. 24 is a side view showing air currents in a concentrated air current control mode of the body of the blower according to an embodiment.
Figure 25:
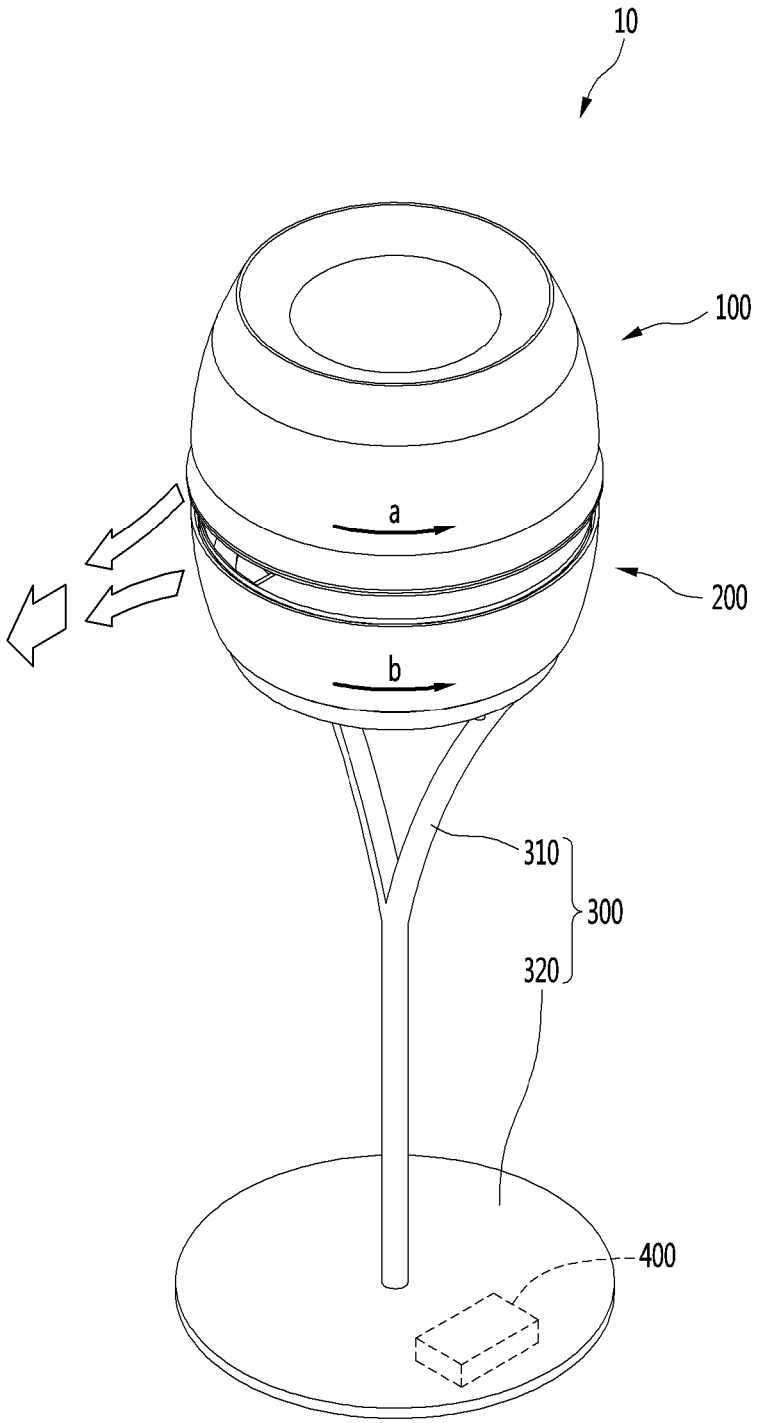
FIG. 25 is a perspective view showing air currents in the concentrated air current control mode of the blower according to an embodiment.
Figure 26:
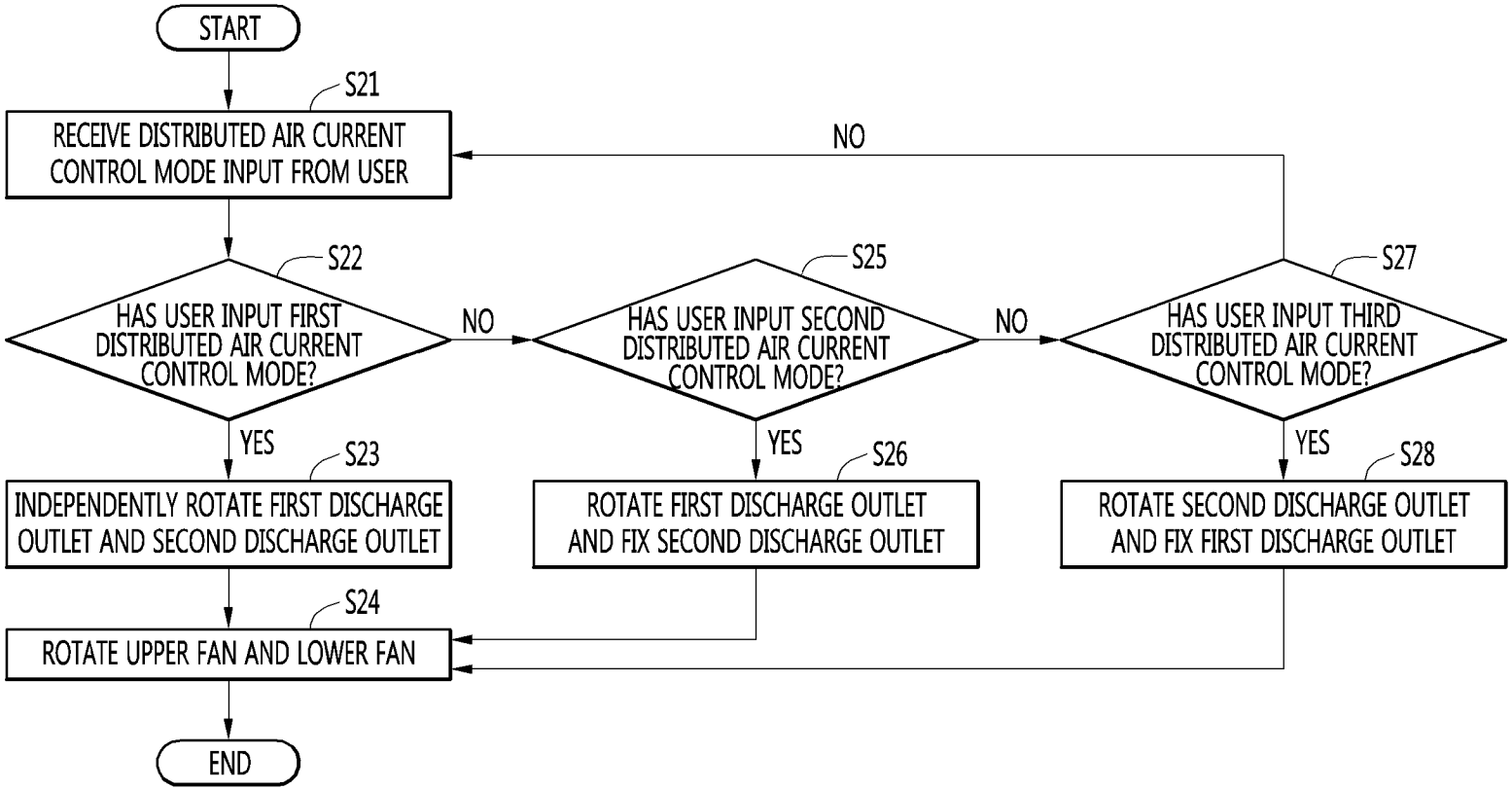
FIG. 26 is a flowchart illustrating a distributed air current control mode method of the blower according to an embodiment.
Figure 27:
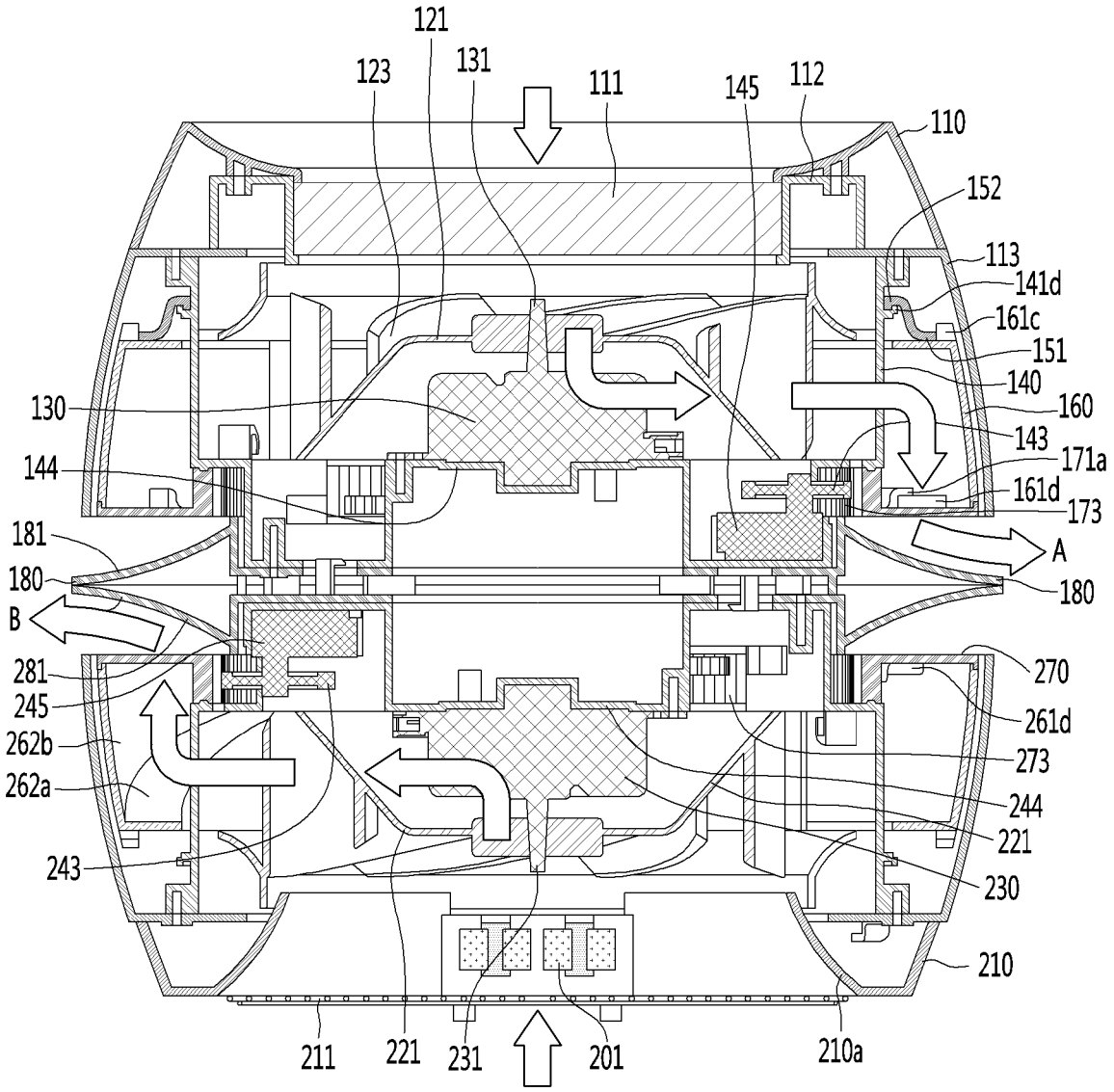
FIG. 27 is a side view showing air currents in a distributed air current control mode of the body of the blower according to an embodiment.

Referring to FIGS. 23 to 25, the concentrated air current control mode may be an operation mode in which air discharged from the first discharge outlet 170 of the first blower 100 and air discharged from the second discharge outlet 270 of the second blower 200 are joined together and then discharged to the outside. In a state in which the first discharge port 172 and the second discharge port 272 of the second discharge outlet 270 are vertically arranged, the first discharge guide and the second discharge guide may be rotated in a same direction at a same speed with respect to a vertical central axis of the first blower 100 and the second blower 200.

The first discharge direction of the first air current A and the second discharge direction of the second air current B may be identical to each other, and the first air current A discharged through the first discharge port 172 and the second current B discharged through the second discharge port 272 may be joined together and then discharged to the outside. An air current obtained by joining together the first air current A and the second air current B may be defined as the third air current.

An example of the concentrated air current control mode will be described hereinafter. The user may input the concentrated air current control mode through the input 410 such that the blower may be operated in the concentrated air current control mode. If the concentrated air current control mode is input, the controller 400 may rotate the first gear motor 145 and the second gear motor 245 such that the first discharge port 172 and the second discharge port 272 are positioned opposite to each other.

If the controller 400 rotates the first gear motor 145 and the second gear motor 245, the first pinion gear 143 connected to the first gear motor 145 and the second pinion gear 243 connected to the second gear motor 245 may be rotated. If the first pinion gear 145 is rotated, the first discharge inlet 170 may be rotated in the circumferential direction as the first rack gear 173 engaged with the first pinion gear 145 is rotated. Accordingly, the first discharge port 172 may also be rotated in the circumferential direction.

If the second pinion gear 245 is rotated, the second discharge inlet 270 may be rotated in the circumferential direction as the second rack gear 273 engaged with the second pinion gear 245 is rotated. Accordingly, the second discharge port 272 may also be rotated in the circumferential direction.

The controller 400 may control the first gear motor 145 and the second gear motor 245 such that the first discharge port 172 and the second discharge port 272 are positioned opposite to each other in the vertical direction. The controller 400 may determine whether a rotation mode has been input from the user through the input 410.

The user may input the rotation mode to the input 410. The user may input, through the input 410, whether a direction of air which is blown in the concentrated air current control mode is to be changed in the circumferential direction. A mode in which the direction of the blown air is changed in the circumferential direction may be defined as the 'rotation mode.'

If the user inputs the rotation mode to the input 410, the controller 400 may control the first gear motor 145 and the second gear motor 245 in the state in which the first discharge port 172 and the second discharge port 272 are arranged opposite to each other in the vertical direction, to rotate the first discharge outlet 170 and the second discharge outlet 270 in the circumferential direction. The controller 400 may control the first gear motor 145 and the second gear motor 245 such that the rotational directions and rotational speeds of the first discharge outlet 170 and the second discharge outlet 270 are equal to each other.

The first pinion gear 143 and the second pinion gear 243 may be rotated in substantially the same direction at the substantially same speed, and the first rack gear 173 connected to the first pinion gear 143 and the second rack gear 273 connected to the second pinion gear 243 may be rotated in the same direction at the same speed. Thus, the first discharge port 173 of the first discharge outlet 170 and the second discharge port 273 of the second discharge outlet 270 may be rotated together when they are vertically arranged opposite to each other.

If the first discharge port 172 and the second discharge port 272 are rotated when they are arranged opposite to each other in the vertical direction, the controller 400 may rotate the upper fan 120 and the lower fan 220. The controller 400 may control the upper fan motor 130 and the lower fan motor 230 to rotate the upper fan 120 and the lower fan 220, thereby generating an air flow. Thus, the air current obtained by joining together the first air current A and the second air current B may be discharged while being rotated in the circumferential direction at a certain speed. Accordingly, air may be circulated in an interior of a discharge space.

When the user does not input the rotation mode to the input 410, the controller 400 may rotate the upper fan 120 and the lower fan 220 by stopping the control of the first gear motor 145 and the second gear motor 245 and simultaneously controlling the upper fan motor 130 and the lower fan motor 230. In this case, the air current obtained by joining together the first air current A and the second air current B may be discharged in only one direction, and air may be blown to a position desired by the user.

If the upper fan 120 and the lower fan 220 are rotated when the controller 400 controls the first gear motor 145 and the second gear motor 245 such that the first discharge port 173 and the second discharge port 273 are positioned opposite to each other in the vertical direction as the concentrated air current control mode is input, the first air current A may be generated in the first blower 100, and the second air current B may be generated in the second blower 200. The first air current A may be generated in an order of the first flow A1, the second flow A2, the third flow A3, and the fourth flow A4. The direction of an air current discharged along the fourth flow A4 may be the first discharge direction. The second air current B may be generated in an order of the fifth flow B1, the sixth flow B2, the seventh flow B3, and the eighth flow B4. The direction of an air current discharged along the eighth flow B4 may be the second discharge direction.

In the concentrated air current control mode, as the first discharge port 172 and the second discharge port 272 are positioned opposite to each other in the vertical direction, the first discharge direction of the first air current A discharged through the first air current changing fin 180 may be equal to the second discharge direction of the second air current B discharged through the second air current changing fin 280. Thus, the first air current A generated from the first blower 100 and the second air current B generated from the second blower 200 may be joined together and then discharged to the outside.

Referring to FIGS. 26 to 30, the distributed air current control mode may be a mode in which air discharged through the first discharge port 172 of the first blower 100 and air discharged through the second discharge port 272 of the second blower 200 may be independently discharged to the outside. As the first discharge port 170 and the second discharge port 272 are independently rotated in the circumferential direction with respect to the vertical central axis of the first blower 100 and the second blower 200, the first air current A generated through the first discharge port 172 and the second air current B generated through the second discharge port 272 may be independently discharged to the outside in different directions.

An example of the distributed air current control mode will be described hereinafter. The user may input the distributed air current control mode to as input, such as input 410, such that the blower may be operated in the distributed air current control mode (S21).

The distributed air current control mode may include a first distributed air current control mode, a second distributed air current control mode, and a third distributed air current control mode. The user may select one distributed air current control mode among the first distributed air current control mode, the second distributed air current control mode, and the third distributed air current control mode and input the selected distributed air current control mode through the input.

The first distributed air current control mode may be a mode in which a first discharge outlet, such as discharge outlet 170, and the second discharge outlet, such as discharge outlet 270, are independently rotated in the circumferential direction. The second distributed air current control mode may be a mode in which the first discharge outlet is rotated and the second discharge outlet is fixed. That is, only the first discharge outlet is rotated in the second distributed air current control mode.

The third distributed air current control mode may be a mode in which the first discharge outlet is fixed and the second discharge outlet is rotated. That is, only the second discharge outlet is rotated in the third distributed air current control mode.

If the user inputs the first distributed air current control mode through the input, an output, such as output 420, may output, to the outside, information notifying the user that the blower is performed in the first distributed air current control mode. A controller, such as controller 400, may control a first gear motor, such as first gear motor 145, and a second gear motor, such as second gear motor 245, to independently rotate the first discharge outlet and the second discharge outlet. In this case, a first discharge port, such as first discharge port 172, and a second discharge port, such as second discharge port 272, may cross each other in the vertical direction.

If the controller rotates the first gear motor and the second gear motor, a first pinion, such as first pinion gear 143, connected to the first gear motor and a second pinion gear, such as second pinion gear 243, connected to the second gear motor may be rotated. The first discharge outlet may be rotated as the first rack gear engaged with the first pinion gear is rotated, and the second discharge outlet may be rotated as the second rack gear engaged with the second pinion gear is rotated.

The controller may independently rotate the first discharge outlet and the second discharge outlet, so that the first discharge direction of the first air current A discharged through the first discharge port and the second discharge direction of the second air current B discharged through the second discharge port may be distant from each other or be close to each other.

The controller may differently control the rotational directions and rotational speeds of the first gear motor and the second gear motor, so that the first discharge outlet and the second discharge outlet may be independently rotated. Accordingly, the directions of the first air current A discharged through the first discharge port and the second air current B discharged through the second discharge port may be equal to each other or be different from each other. In other words, the first air current A and the second air current B may be independently generated.

Figure 28:
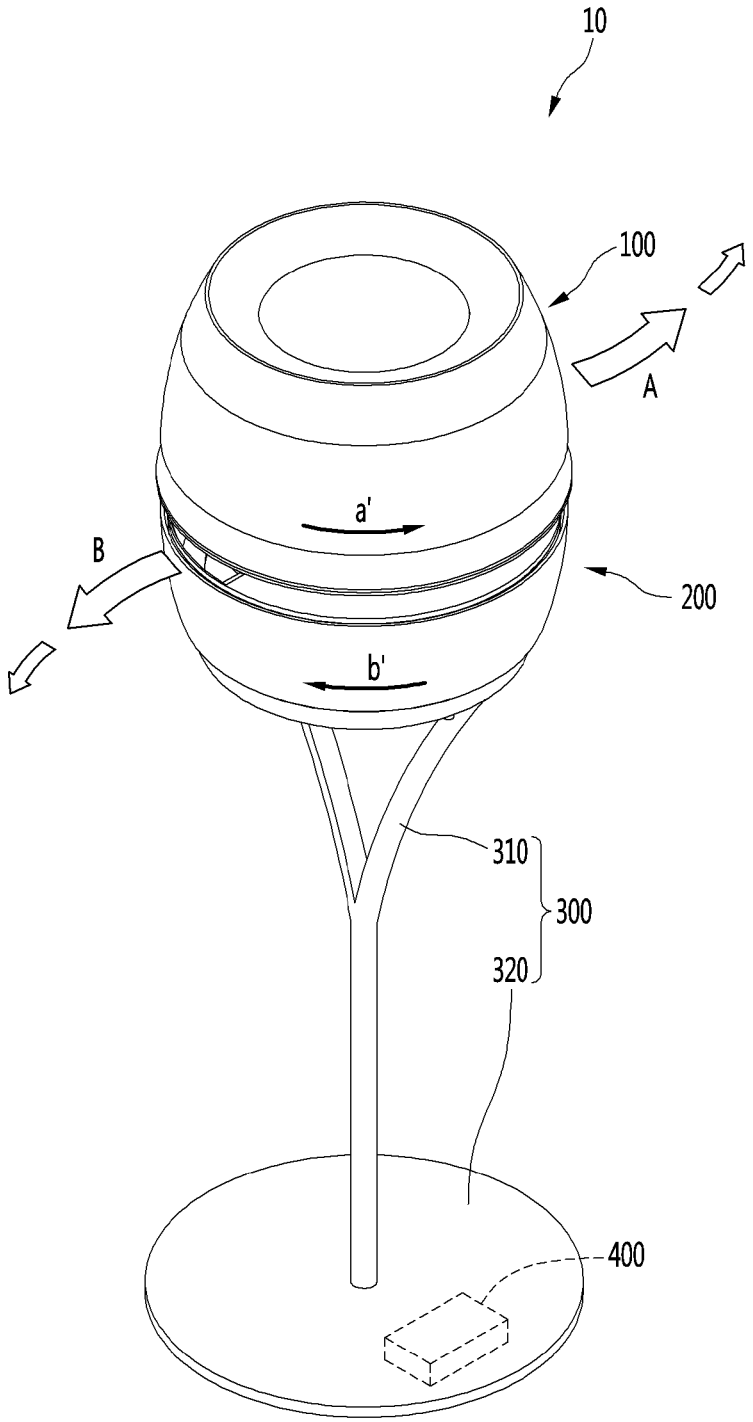
FIG. 28 is a perspective view showing air currents in a first distributed air current control mode of the blower according to an embodiment.
Figure 29:
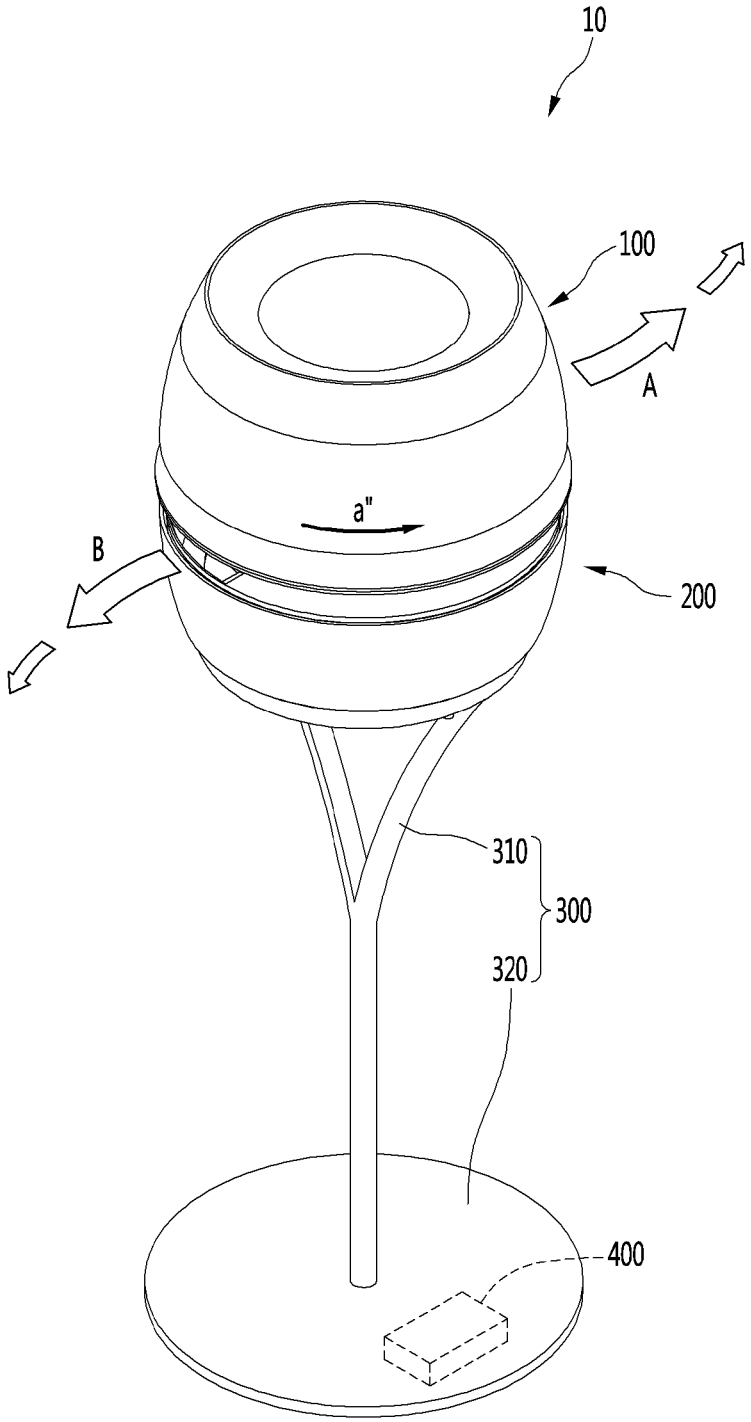
FIG. 29 is a perspective view showing air currents in a second distributed air current control mode of the blower according to an embodiment.
Figure 30:
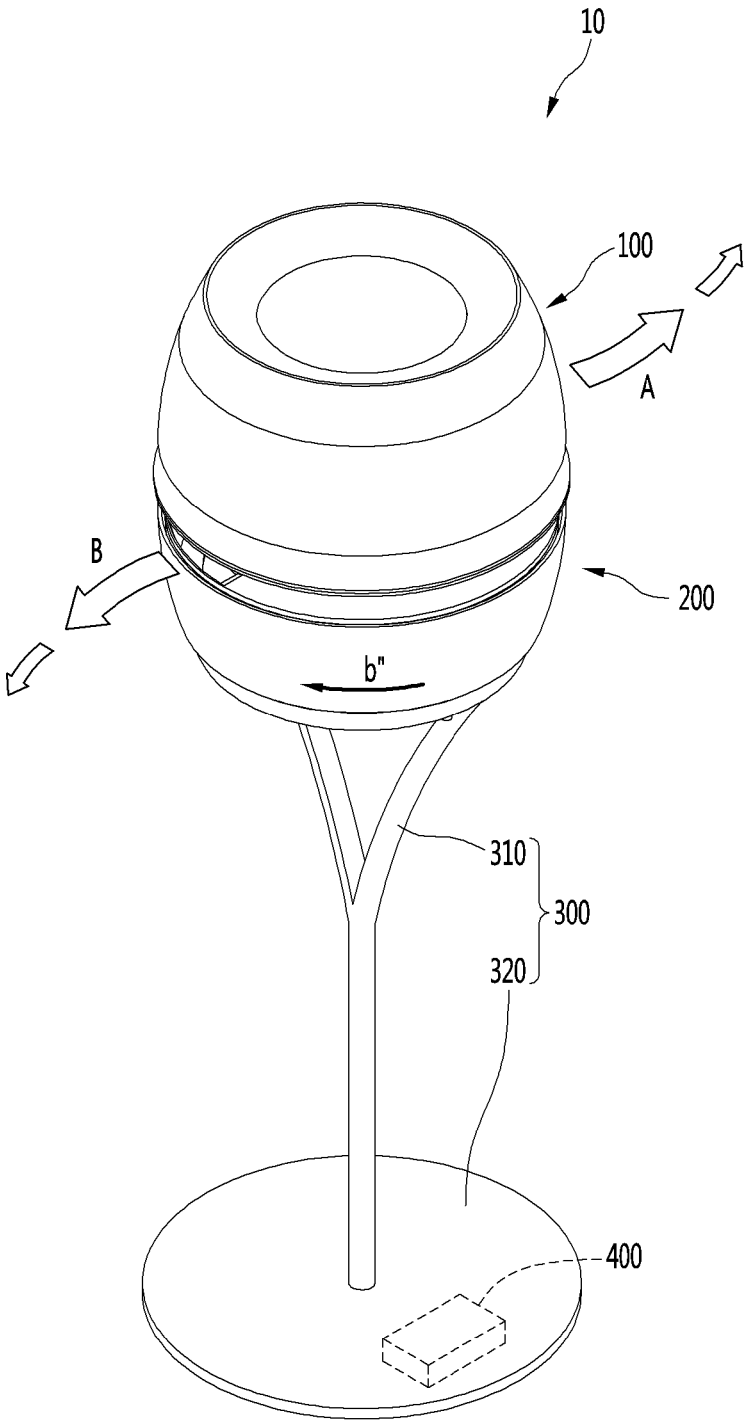
FIG. 30 is a perspective view showing air currents in a third distributed air current control mode of the blower according to an embodiment.

For example, the controller may control the first gear motor to rotate the first discharge outlet such that the first air current A discharged through the first discharge port may be discharged in direction a' of FIG. 28. Also, the controller may control the second gear motor to rotate the second discharge outlet such that the second air current B discharged through the second discharge port 272 may be discharged in direction b' of FIG. 28.

Accordingly, the first air current A which is discharged through the first discharge port to have a flow direction changed by a first air current changing fin, such as first air current changing fin 180, may be discharged in a first discharge direction, and the second air current B which is discharged through the second discharge port to have a flow direction changed by a second air current changing fin, such as second air current changing fin 280, may be discharged in a second discharge direction. In this case, the first discharge direction and the second discharge direction may be distant from each other or be close to each other. In addition, the first discharge direction and the second discharge direction may be equal to each other (S22,S23,S24).

If the user inputs the second distributed air current control mode through the input, the output may output, to the outside, information notifying that the blower is performing in the second distributed air current control mode. The controller may control the first gear motor to rotate the first discharge outlet in direction a" of FIG. 29. In this case, the controller may not control the second gear motor, and accordingly, the second discharge outlet may remain fixed without being rotated.

If the controller rotates the first gear motor, the first pinion gear connected to the first gear motor may be rotated. As the first rack gear engaged with the first pinion gear is rotated, the first discharge outlet may be rotated.

As the controller rotates the first discharge outlet, the first discharge direction of the first air current A discharged through the first discharge port 172 may be rotated to the circumferential direction, and the second discharge outlet may not be rotated. Accordingly, the second discharge direction of the second air current B discharged through the second discharge port may be constantly maintained.

In the second distributed air current control mode, the first air current A may be discharged while being rotated in the circumferential direction with respect to the vertical central axis of the first blower, and the second air current B may be discharged in a constant direction. For example, the controller may control the first gear motor to rotate the first discharge outlet such that the first air current A discharged through the first discharge port may be discharged while being rotated in the direction a' of FIG. 28 (S25, S26).

If the user inputs the third distributed air current control mode through the input, the output may output, to the outside, information notifying that the blower is performing in the third distributed air current control mode. The controller may control the second gear motor to rotate the second discharge outlet in direction b" of FIG. 30. In this case, the controller 400 may not control the first gear motor, and accordingly, the first discharge outlet may remain fixed without being rotated.

If the controller rotates the second gear motor, the second pinion gear connected to the second gear motor may rotate. As the second rack gear engaged with the second pinion gear is rotated, the second discharge outlet may be rotated.

As the controller rotates the second discharge outlet, the second discharge direction of the second air current B discharged through the second discharge port may be rotated to the circumferential direction, and the first discharge outlet may not be rotated. Accordingly, the first discharge direction of the first air current A discharged through the first discharge port may be constantly maintained.

In the third distributed air current control mode, the second air current B may be discharged while being rotated in the circumferential direction with respect to the vertical central axis of the second blower, and the first air current A may be discharged in the constant direction. For example, the controller may control the second gear motor to rotate the second discharge outlet such that the second air current B discharged through the second discharge port 272 may be discharged while being rotated in the direction a' of FIG. 28 (S27,S28).

As described above, in the blower according to the embodiment, the first and second air currents respectively discharged from the first and second blowers may be discharged while being equally rotated or may be discharged while being independently rotated, so that the direction of discharged air may be freely controlled.

Further, air may be discharged by 360 degrees in the circumferential direction, so that, even when a plurality of users are located at different positions, air may be blown toward all of the users.

A blower according to embodiments is provided that may include an upper fan that generates a first air current suctioned through an upper suction part or inlet and then discharged; a lower fan provided at a lower side of the upper fan, wherein the lower fan generates a second air current suctioned through a lower suction part or inlet and then discharged. The blower may further include a first discharge part or outlet rotatably provided at an entrance of the upper fan, the first discharge part discharging the first air current in a radial direction, and a second discharge part or outlet rotatably provided at an entrance of the lower fan, the second discharge part discharging the second air current in a radial direction.

The blower may further include a controller that controls rotation of at least one of the first discharge part or the second discharge part, to control a first discharge direction of the first air current and a second discharge direction of the second air current. The upper fan may be driven such that the first air current flows downwardly from the upper suction part and is discharged in a lateral direction. The lower fan may be driven such that the second air current flows upwardly from the lower suction part and is discharged in a lateral direction.

The upper fan and the lower fan may be driven such that the first and second air currents are joined together and then discharged. The controller may control rotation of the first discharge part in the circumferential direction, to control the first discharge direction of the first air current.

The controller may control rotation of the second discharge part in the circumferential direction, to control the second discharge direction of the second air current. The controller may equally control the rotational directions of the first discharge part and the second discharge part such that the first discharge direction and the second discharge direction are equal to each other. The controller may differently control the rotational directions of the first discharge part and the second discharge part such that the first discharge direction and the second discharge direction are different from each other.

The blower may further include an air current changing device or fin disposed or provided between the first discharge part and the second discharge part, to guide the first discharge direction and the second discharge direction in a radial direction. The air current changing device may generate a third air current in which the first air current and the second air current are joined together and then discharged, when the first discharge direction and the second discharge direction are equal to each other.

The first discharge part may include a first discharge body rotatably provided, and a first discharge port opened by a set or predetermined length in an extending direction of the first discharge body to be disposed in the first discharge body. The second discharge part may include a second discharge body rotatably provided, and a second discharge port opened by a set or predetermined length in an extending direction of the second discharge body to be disposed in the second discharge body.

The controller may control rotations of the first discharge body and the second discharge body such that the first discharge port and the second discharge port may be vertically aligned with each other, to allow the first discharge direction and the second discharge direction to be equal to each other. The controller may control rotations of the first discharge body and the second discharge body such that the first discharge port and the second discharge port vertically cross each other, to allow the first discharge direction and the second discharge direction to be different from each other.

The blower may further include a first gear motor driven to rotate the first discharge part; a first pinion gear rotatably connected to the first gear motor; and a first rack gear provided at an inner circumferential surface of the first discharge body, the first rack gear being engaged with the first pinion gear. The blower may further include a second gear motor driven to rotate the second discharge part; a second pinion gear rotatably connected to the second gear motor; and a second rack gear provided at an inner circumferential surface of the second discharge body, the second rack gear being engaged with the second pinion gear.

The blower according to embodiments configured as described above may have at least the following advantages. First, as air is discharged while being rotated by 360 degrees in the circumferential direction with respect to the central axis of the blower, air may be blown toward a user who is located at any position. Accordingly, it may be possible to minimize an inconvenience that the user should manually move the blower. Second, even when users are located at different positions, air is blown toward all of the users, so that air may be discharged throughout a wide area in an indoor space.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower comprising:

a first fan that generates a first air current suctioned in through a first suction inlet and then discharged;

a second fan provided adjacent to the first fan, wherein the second fan generates a second air current suctioned in through a second suction inlet and then discharged;

a first discharge outlet rotatably provided at an outlet of the first fan;

a first discharge port in the form of an opening that extends along a circumferential direction of and vertically through the first discharge outlet, the first discharge port guiding the first air current in a downward direction;

a second discharge outlet rotatably provided at an outlet of the second fan;

a second discharge port in the form of an opening that extends along a circumferential direction of and vertically through the second discharge outlet, the second discharge port guiding the second air current in an upward direction; and a controller that controls a rotation of the first discharge outlet and the second discharge outlet, to control a first discharge direction of the first air current and a second discharge direction of the second air current, wherein the first discharge port and the second discharge port are positioned to face each other in a vertical direction when aligned.

2. The blower of claim 1, wherein the controller controls the rotation of the first discharge outlet in a circumferential direction, to control the first discharge direction of the first air current, and wherein the controller controls the rotation of the second discharge outlet in the circumferential direction, to control the second discharge direction of the second air current.

3. The blower of claim 2, wherein the controller controls the first discharge outlet and the second discharge outlet to rotate in a same direction such that the first discharge direction and the second discharge direction are the same.

4. The blower of claim 2, wherein the controller controls the first discharge outlet and the second discharge outlet to rotate in opposite directions such that the first discharge direction and the second discharge direction are different from each other.

5. The blower of claim 1, further including at least one air current changing fin provided between the first discharge outlet and the second discharge outlet, to guide the first air current and the second air current in a radial direction, and wherein the at least one air current changing fin generates a third air current in which the first air current and the second air current are joined together and then discharged when the first discharge direction and the second discharge direction are the same.

6. The blower of claim 1, wherein the first discharge outlet includes:

a rotatable first discharge body, wherein the first discharge port extends in the circumferential direction and passes through the first discharge body.

7. The blower of claim 6, wherein the second discharge outlet includes:

a rotatable second discharge body, wherein the second discharge port extends in the circumferential direction and passes through the second discharge body.

8. The blower of claim 7, wherein the controller controls the rotation of the first discharge body and the second discharge body such that the first discharge port and the second discharge port are vertically aligned with each other, to allow the first discharge direction and the second discharge direction to be the same.

9. The blower of claim 7, wherein the controller controls the rotation of the first discharge body and the second discharge body such that the first discharge port and the second discharge port are vertically offset, to allow the first discharge direction and the second discharge direction to be different from each other.

10. The blower of claim 7, further including:

a first gear motor configured to rotate the first discharge outlet;

a first pinion gear rotatably connected to the first gear motor; and a first rack gear provided at an inner circumferential surface of the first discharge body, the first rack gear being engaged with the first pinion gear.

11. The blower of claim 10, further including:

a second gear motor configured to rotate the second discharge outlet;

a second pinion gear rotatably connected to the second gear motor; and a second rack gear provided at an inner circumferential surface of the second discharge body, the second rack gear being engaged with the second pinion gear.

12. The blower of claim 1, further including an air current changing fin positioned between the first fan and the second fan and configured to guide the first air current discharged from the first discharge port and the second air current discharge from the second discharge port in a radial direction.

13. A blower comprising:

an upper fan that generates a first air current suctioned through an upper suction inlet and then discharged;

a lower fan provided below the upper fan, wherein the lower fan generates a second air current suctioned through a lower suction inlet and then discharged;

a first discharge outlet rotatably provided at an outlet of the upper fan and including an inner circumferential edge having an upper set of teeth, wherein the first discharge outlet discharges the first air current downward through a first discharge port;

a second discharge outlet rotatably provided at an outlet of the lower fan and including an inner circumferential edge having a lower set of teeth, wherein the second discharge outlet discharges the second air current upward through a second discharge port;

a first gear motor configured to rotate a first pinion gear that interacts with the upper set of teeth;

a second gear motor configured to rotate a second pinion gear that interacts with the lower set of teeth; and a controller that controls a rotation of the first gear motor and second gear motor to rotate the first discharge outlet and the second discharge outlet, to control a first discharge direction of the first air current and a second discharge direction of the second air current, wherein the first discharge port and the second discharge port are opposite to one another in a vertical direction when aligned.

14. The blower of claim 13, further including:

a first air current changing fin provided below the first discharge outlet and configured to discharge air from the first discharge port in a radial direction; and a second air current changing fin provided above the second discharge outlet and configured to discharge air from the second discharge port in a radial direction.

15. The blower of claim 14, wherein the controller controls the rotation of the first gear motor and the second gear motor such that the first discharge outlet and the second discharge outlet discharge air in different directions from each other.

16. The blower of claim 14, wherein the controller controls the rotation of the first gear motor and the second gear motor such that the first discharge outlet and the second discharge outlet discharge air in a same direction.

17. A blower, comprising:

an upper fan that generates a first air current suctioned through an upper suction inlet and then discharged;

a lower fan provided below the upper fan, wherein the lower fan generates a second air current suctioned through a lower suction inlet and then discharged;

a first discharge outlet rotatably provided at an outlet of the upper fan, wherein the first discharge outlet discharges the first air current downward through a first discharge port;

a second discharge outlet rotatably provided at an outlet of the lower fan, wherein the second discharge outlet discharges the second air current upward through a second discharge port;

a first gear motor configured to rotate the first discharge outlet;

a second gear motor configured to rotate the second discharge outlet;

a controller that controls a rotation of the first gear motor and second gear motor to rotate the first discharge outlet and the second discharge outlet, to control a first discharge direction of the first air current and a second discharge direction of the second air current;

a first air current changing fin provided below the first discharge outlet and configured to discharge air from the first discharge port in a radial direction; and a second air current changing fin provided above the second discharge outlet and configured to discharge air from the second discharge port in a radial direction.

18. The blower of claim 17, wherein the first discharge outlet has a ring shape and includes an upper set of teeth along an inner circumferential edge, and the second discharge outlet has a ring shape and includes a lower set of teeth along an inner circumferential edge.

19. The blower of claim 18, further including a first pinion gear configured to be rotated by the first gear motor and interact with the upper set of teeth to rotate the first discharge outlet, and a second pinion gear configured to be rotated by the second gear motor and interact with the lower set of teeth to rotate the second discharge outlet.

20. The blower of claim 17, wherein the controller further controls the upper and lower fans to rotate at different speeds, such that a stronger air current is produced from one of the upper and lower fans.

* * * * *